US009952554B2

(12) United States Patent
Itabashi et al.

(10) Patent No.: US 9,952,554 B2
(45) Date of Patent: Apr. 24, 2018

(54) DEVELOPING CARTRIDGE HAVING ELECTRODE PROVIDED WITH PROTRUSION

(71) Applicant: Brother Kyogo Kabushiki Kaisha, Nagoya-shi, Aichi-ken (JP)

(72) Inventors: Nao Itabashi, Nagoya (JP); Hiroki Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/275,533

(22) Filed: Sep. 26, 2016

(65) Prior Publication Data

US 2017/0269542 A1 Sep. 21, 2017

(30) Foreign Application Priority Data

Mar. 16, 2016 (JP) ..... 2016-052647

(51) Int. Cl.
*G03G 21/16* (2006.01)
*G03G 21/18* (2006.01)
*G03G 15/08* (2006.01)

(52) U.S. Cl.
CPC ..... *G03G 21/1652* (2013.01); *G03G 15/0889* (2013.01); *G03G 21/1867* (2013.01); *G03G 21/1896* (2013.01)

(58) Field of Classification Search
CPC ..... G03G 21/1652; G03G 15/0889; G03G 21/1676; G03G 21/1867; G03G 21/1875; G03G 21/1896
See application file for complete search history.

(56) References Cited

U.S. PATENT DOCUMENTS 9,195,207 B2 11/2015 Itabashi
2013/0051816 A1 2/2013 Itabashi
(Continued)

FOREIGN PATENT DOCUMENTS

JP 2008-242085 A 10/2008
JP 2013-054053 A 3/2013
(Continued)

OTHER PUBLICATIONS

Dec. 20, 2016—(WO) International Search Report and Written Opinion—App PCT/JP2016/078174, English Translation.

*Primary Examiner* — David M Gray
*Assistant Examiner* — Laura Roth
(74) *Attorney, Agent, or Firm* — Banner & Witcoff, Ltd.

(57) ABSTRACT

A developing cartridge includes: a casing configured to store developer; a developing roller configured to rotate about a first axis extending in a first direction; a shaft provided at one end of the casing in the first direction; and an electrode configured to rotate about the shaft and supply power to the developing roller. The shaft extends in the first direction and has a peripheral surface. The electrode has a first protrusion configured to rotate together with the electrode, the first protrusion extending along a portion of the peripheral surface of the shaft. The electrode has a second protrusion extending along the peripheral surface of the shaft, the second protrusion being spaced apart from the first protrusion in the rotating direction. The first protrusion has a first length in the rotating direction, and the second protrusion has a second length different from the first length in the rotating direction.

20 Claims, 16 Drawing Sheets

(56) References Cited

U.S. PATENT DOCUMENTS

| | | | | |
|---|---|---|---|---|
| 2013/0084081 | A1 | 4/2013 | Itabashi et al. | |
| 2014/0086613 | A1* | 3/2014 | Itabashi ..... | G03G 15/0863 399/90 |
| 2015/0192880 | A1 | 7/2015 | Noda et al. | |
| 2016/0054702 | A1 | 2/2016 | Itabashi | |

FOREIGN PATENT DOCUMENTS

| | | | |
|---|---|---|---|
| JP | 2013-073213 | A | 4/2013 |
| JP | 2015-129815 | A | 7/2015 |

* cited by examiner

DEVELOPING CARTRIDGE HAVING ELECTRODE PROVIDED WITH PROTRUSION

CROSS REFERENCE TO RELATED APPLICATION

This application claims priority from Japanese Patent Application No. 2016-052647 filed Mar. 16, 2016. The entire content of the priority application is incorporated herein by reference.

TECHNICAL FIELD

The present disclosure relates to a developing cartridge.

BACKGROUND

There is known a developing cartridge including a developing roller. The developing cartridge is detachably attachable to an image-forming apparatus.

For example, a conventional developing cartridge having an electrode for supplying power to a developing roller. The electrode has a shaft that can contact a power-supply section of an image-forming apparatus. This developing cartridge further includes a gear rotatable about the shaft and a protrusion provided on the gear. The protrusion can rotate together with the gear and is configured to contact a lever of the image-forming apparatus. The lever is moved when the protrusion contacts the lever. The image-forming apparatus can detect movement of the lever to thereby determine a specification of the developing cartridge attached to the image-forming apparatus.

SUMMARY

There is a demand that the above-described gear and the electrode be constituted by a single component.

In view of the foregoing, it is an object of the present disclosure to provide a developing cartridge whose specification can be detected by using an electrode.

In order to attain the above and other objects, there is provided a developing cartridge including a casing, a developing roller, a shaft, and an electrode. The casing is configured to store developer. The developing roller is rotatable about a first axis extending in a first direction, the casing having one end and another end in the first direction. The shaft is provided at the one end of the casing, the shaft extending in the first direction and having a peripheral surface. The electrode is rotatable about the shaft in a rotating direction and supply power to the developing roller, the electrode including a first protrusion rotatable together with the electrode, the first protrusion extending along a portion of the peripheral surface of the shaft.

DETAILED DESCRIPTION

1. First Embodiment

A developing cartridge 1 according to a first embodiment of the present disclosure will be described while referring to accompanying drawings.

1-1. Overview of Developing Cartridge

First, an overall structure of the developing cartridge 1 will be described with reference to FIG. 1.

Figure 1:
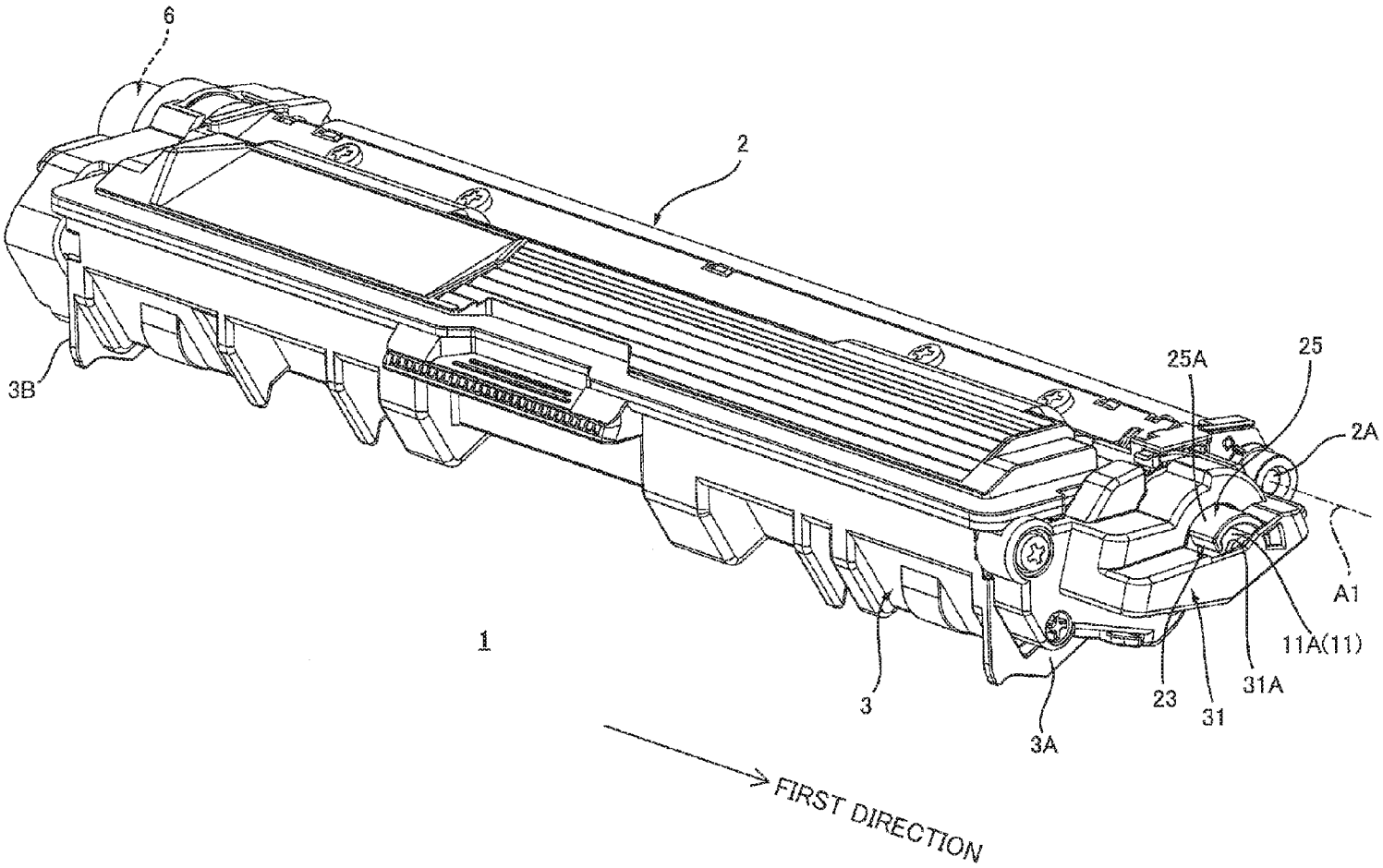
FIG. 1 is a perspective view of a developing cartridge according to a first embodiment of the present disclosure.

As illustrated in FIG. 1, the developing cartridge 1 includes a developing roller 2 and a casing 3.

The developing roller 2 is configured to carry developer thereon. The developing roller 2 extends in a first direction shown in FIG. 1. The developing roller 2 is rotatable about a first axis A1 extending in the first direction. Specifically, the developing roller 2 includes a developing-roller shaft 2A. The developing-roller shaft 2A extends in the first direction. The developing-roller shaft 2A is made of a metal such as a stainless steel or iron.

The casing 3 is configured to contain the developer inside thereof. The developer is toner powder, for example. The casing 3 has a rectangular cylindrical shape. Specifically, the casing 3 has a first outer surface 3A and a second outer surface 3B. The first outer surface 3A is an outer surface of the casing 3 in the first direction. The second outer surface 3B is another outer surface of the casing 3 in the first direction. The second outer surface 3B is separated from the first outer surface 3A in the first direction.

As illustrated in FIG. 1, the developing cartridge 1 further includes a coupling 6, an electrode 23, and a cover 31. The electrode 23 is positioned at the first outer surface 3A. The electrode 23 is rotatable about a shaft 11 of the first outer surface 3A. The cover 31 is fitted to the first outer surface 3A. The cover 31 covers at least a portion of the electrode 23.

More in detail, as illustrated in FIG. 1, the electrode 23 includes a first protrusion 25. The cover 31 is formed with an opening 31A. The opening 31A penetrates the cover 31. The first protrusion 25 of the electrode 23 is exposed outside through the opening 31A.

The coupling 6 is positioned at the second outer surface 3B. That is, the cover 31 is positioned opposite to the coupling 6 with respect to the casing 3 in the first direction.

1-2. Coupling 6

Next, a detailed structure of the coupling 6 will be described with reference to FIG. 2.

The coupling 6 is configured to receive a drive force from an image-forming apparatus. As illustrated in FIG. 2, the coupling 6 is rotatable about a third axis A3 extending in the first direction. Specifically, the coupling 6 is rotatable about the third axis A3 upon receipt of the drive force input from a drive-force input part (not shown) of the image-forming apparatus.

Figure 2:
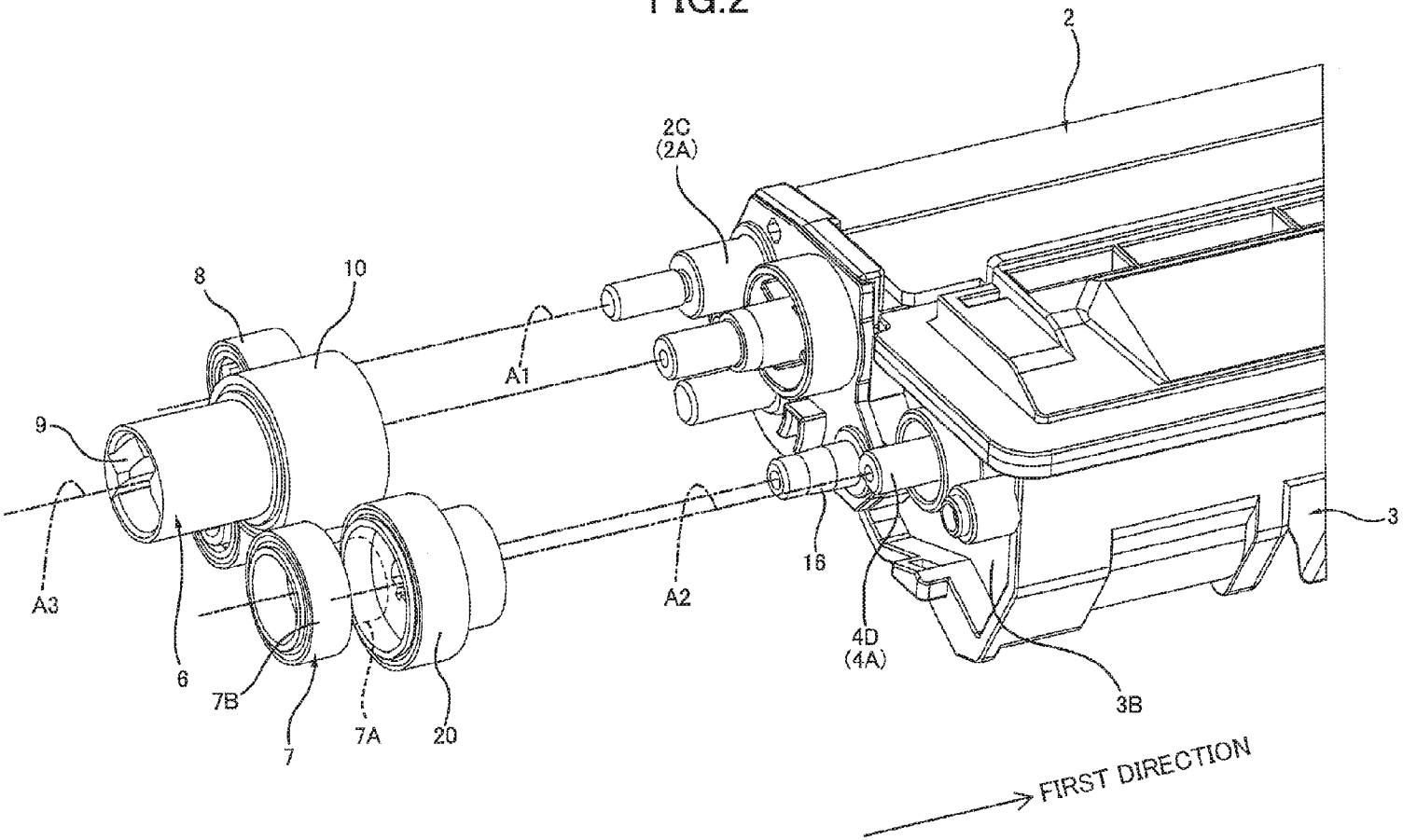
FIG. 2 is an exploded perspective view of components provided on a second outer surface of the developing cartridge according to the first embodiment.

As illustrated in FIG. 2, the coupling 6 includes a joint 9 and a coupling gear 10.

The coupling gear 10 is positioned at one end portion of the coupling 6 in the first direction. The joint 9 is positioned at another one end portion of the coupling 6 in the first direction.

The joint 9 is configured to be engaged with the drive-force input part (not shown) of the image-forming apparatus. The engagement of the joint 9 with the drive-force input part allows the coupling 6 to receive the drive force from the drive-force input part. Based on the received drive force, the joint 9 can rotate about the third axis A3.

The coupling gear 10 is formed integrally with the joint 9. Thus, the coupling gear 10 is rotatable about the third axis A3 together with the joint 9. The coupling gear 10 includes a plurality of gear teeth. The plurality of gear teeth is provided on a peripheral surface of the coupling gear 10 in a rotating direction of the coupling gear 10.

1-3. Developing-Roller Gear 8

The developing cartridge 1 further includes a developing-roller gear 8. As shown in FIG. 2, the developing-roller gear 8 is positioned at the second outer surface 3B. The developing-roller gear 8 includes a plurality of gear teeth. The plurality of gear teeth is provided on a peripheral surface of the developing-roller gear 8 in a rotating direction of the developing-roller gear 8. The developing-roller gear 8 is meshed with the coupling gear 10. Specifically, at least one gear tooth of the plurality of gear teeth of the developing-roller gear 8 is meshed with at least one tooth of the plurality of gear teeth of the coupling gear 10.

The developing-roller gear 8 is rotatable together with the developing roller 2. Specifically, the developing-roller gear 8 is rotatable together with the developing-roller shaft 2A of the developing roller 2.

Figure 3:
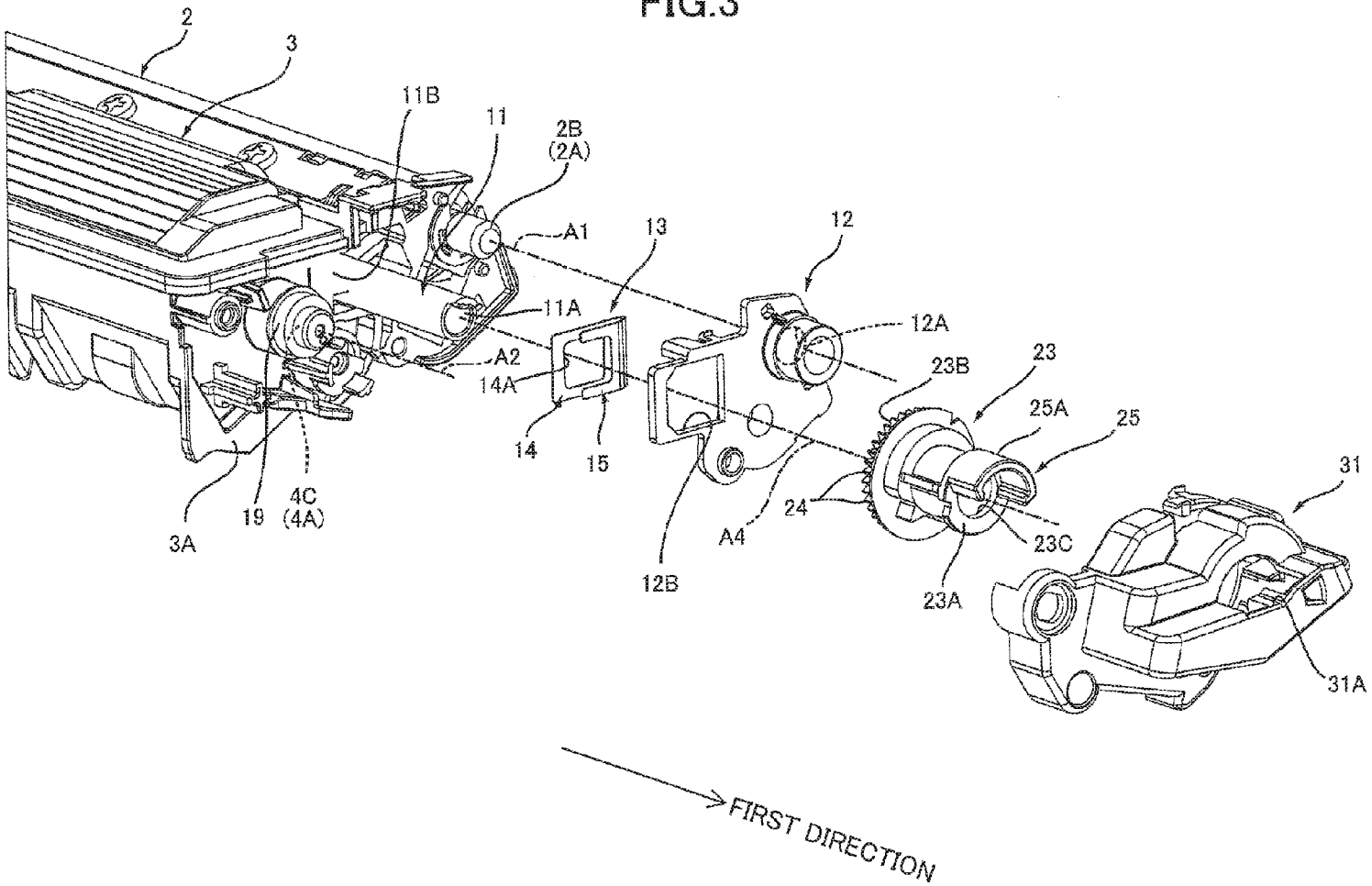
FIG. 3 is s an exploded perspective view of components provided on a first outer surface of the developing cartridge according to the first embodiment.

More specifically, as illustrated in FIGS. 2 and 3, the developing-roller shaft 2A has one end portion 2B and another other end portion 2C separated from the one end portion 2B in the first direction. The one end portion 2B is one end portion of the developing roller 2 in the first direction. The other end portion 2C is another other end portion of the developing roller 2 in the first direction. The one end portion 2B of the developing-roller shaft 2A penetrates the first outer surface 3A and is exposed outside the casing 3. The other end portion 2C of the developing-roller shaft 2A penetrates the second outer surface 3B and is exposed outside the casing 3. As illustrated in FIG. 2, the developing-roller gear 8 is mounted to the other end portion 2C of the developing-roller shaft 2A. Thus the developing-roller gear 8 is rotatable together with the developing-roller shaft 2A. That is, the developing-roller gear 8 is positioned at the other side of the developing roller 2 in the first direction.

1-4. Idle Gear 7

The developing cartridge 1 further includes an idle gear 7. The idle gear 7 is positioned at the second outer surface 3B. The idle gear 7 includes a first gear 7A and a second gear 7B. The first gear 7A is positioned at one end portion of the idle gear 7 in the first direction. The second gear 7B is positioned at another end portion of the idle gear 7 in the first direction. The second gear 7B has a diameter larger than a diameter of the first gear 7A. The first gear 7A includes a plurality of gear teeth. The plurality of gear teeth of the first gear 7A is provided on a peripheral surface of the first gear 7A in a rotating direction of the idle gear 7. The second gear 7B includes a plurality of gear teeth. The plurality of gear teeth of the second gear 7B is provided on a peripheral surface of the second gear 7B in the rotating direction of the idle gear 7. The idle gear 7 is meshed with the coupling gear 10. Specifically, at least one gear tooth of the plurality of gear teeth of the second gear 7B is meshed with at least one gear tooth of the plurality of gear teeth of the coupling gear 10. The idle gear 7 is rotatable about a boss 16 provided on the second outer surface 3B.

1-5. Agitator Gear 4

Figure 7:
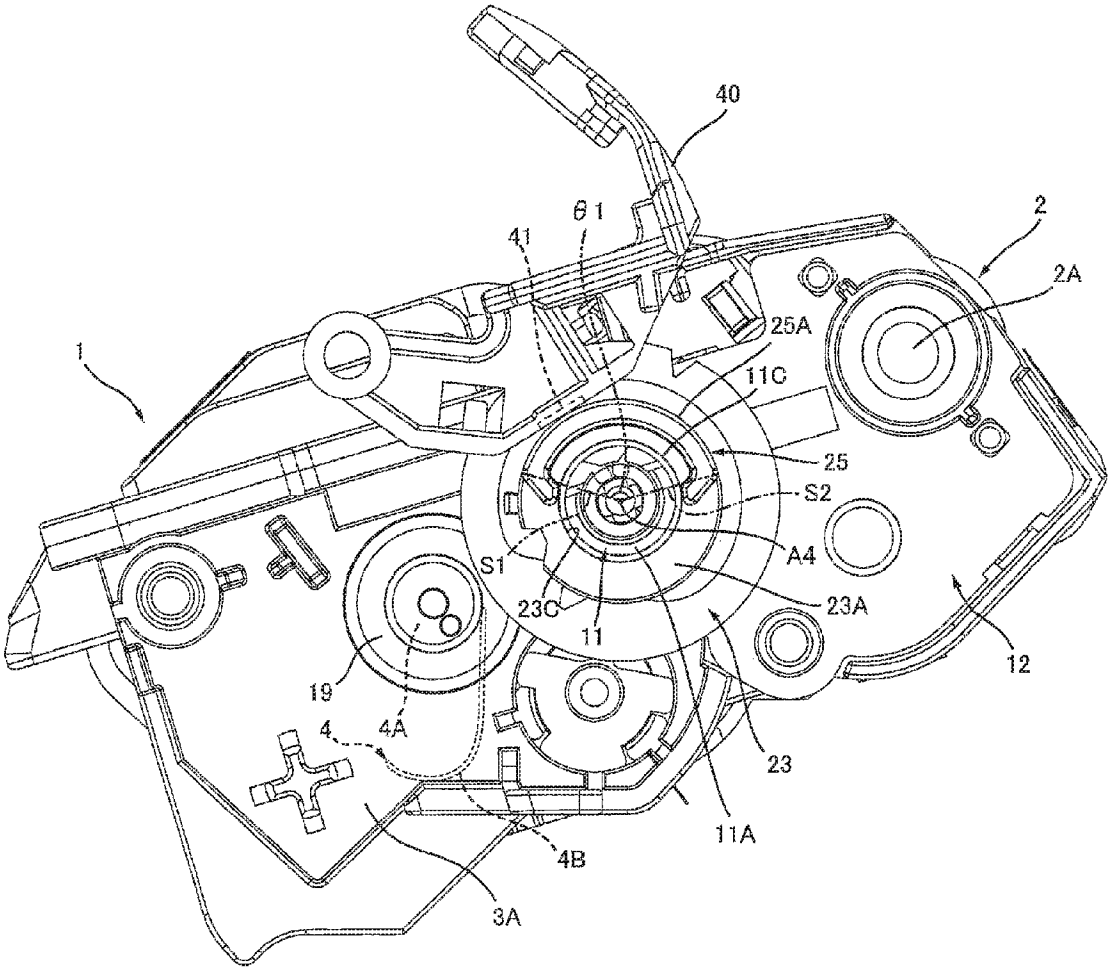
FIG. 7 is a view explaining how the developing cartridge according to the first embodiment is detected, wherein a first protrusion of the developing cartridge is in contact with a device-side electrode of an image-forming apparatus.

As illustrated in FIG. 7, the developing cartridge 1 further includes an agitator 4. The agitator 4 is configured to agitate the developer in the casing 3. As illustrated in FIG. 2, the agitator 4 is rotatable about a second axis A2 extending in the first direction.

As shown in FIG. 7, the agitator 4 includes an agitator shaft 4A and a fin 4B. The agitator shaft 4A extends in the first direction. The agitator shaft 4A is positioned to be separated from the developing-roller shaft 2A. The fin 4B is disposed inside the casing 3. That is, the fin 4B is positioned between the first outer surface 3A and the second outer surface 3B in the first direction. The fin 4B is rotatable about the second axis A2 together with the agitator shaft 4A.

As illustrated in FIGS. 2 and 3, the agitator shaft 4A has one end portion 4C and another end portion 4D separated from the one end portion 4C in the first direction. The one end portion 4C is one end portion of the agitator 4 in the first direction. The other end portion 4D is another end portion of the agitator 4 in the first direction. The one end portion 4C penetrates the first outer surface 3A and is exposed outside the casing 3. The other end portion 4D penetrates the second outer surface 3B and is exposed outside the casing 3.

1-6. First Agitator Gear 19 and Second Agitator Gear 20

As illustrated in FIGS. 2 and 3, the developing cartridge 1 further includes a first agitator gear 19 and a second agitator gear 20.

The second agitator gear 20 is positioned at the second outer surface 3B. The second agitator gear 20 is rotatable together with the agitator 4. Specifically, the second agitator gear 20 is mounted to the other end portion 4D of the agitator shaft 4A and is rotatable together with the agitator shaft 4A. The second agitator gear 20 includes a plurality of gear teeth. The plurality of gear teeth is provided on a peripheral surface of the second agitator gear 20 in a rotating direction of the second agitator gear 20. The second agitator gear 20 is meshed with the idle gear 7. Specifically, at least one gear tooth of the plurality of gear teeth of the first gear 7A is meshed with at least one gear tooth of the plurality of gear teeth of the second agitator gear 20. With this structure, the agitator 4 is rotatable about the second axis A2 in accordance with rotation of the coupling gear 10.

Figure 4:
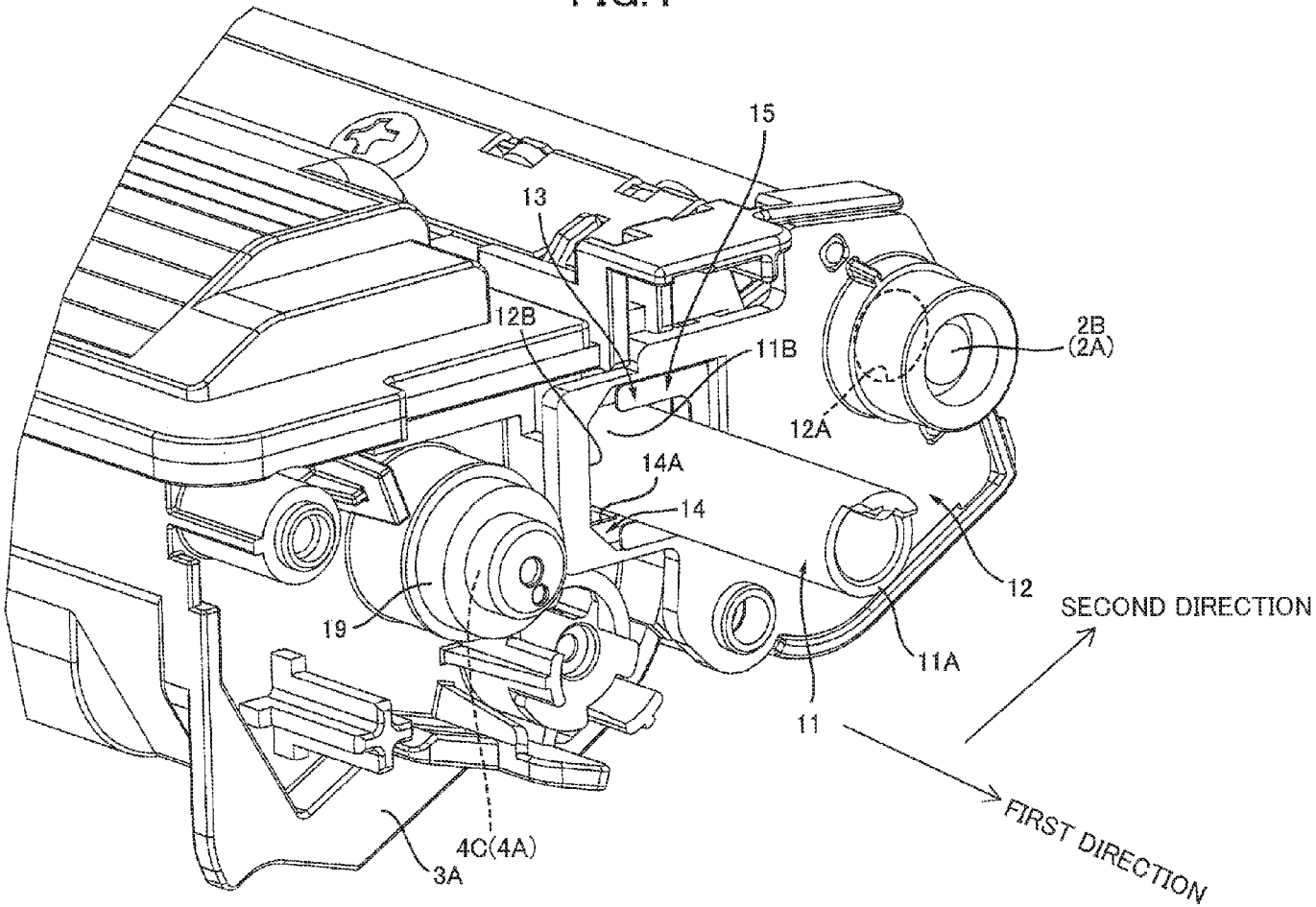
FIG. 4 is a perspective view showing a bearing member and a relay electrode attached to a casing of the developing cartridge according to the first embodiment shown in FIG. 3.

As illustrated in FIGS. 3 and 4, the first agitator gear 19 is positioned at the first outer surface 3A. That is, the first agitator gear 19 is positioned opposite to the coupling 6 with respect to the casing 3 in the first direction. Put another way, the first agitator gear 19 is positioned opposite to the second agitator gear 20 with respect to the casing 3 in the first direction. The first agitator gear 19 is rotatable together with the agitator 4. Specifically, the first agitator gear 19 is mounted to the one end portion 4C of the agitator shaft 4A and is rotatable together with the agitator shaft 4A. That is, the first agitator gear 19 is positioned at the one side of the agitator 4 in the first direction. The second agitator gear 20 is positioned at the other side of the agitator 4 in the first direction.

The first agitator gear 19 includes a plurality of gear teeth. The plurality of gear teeth is provided on a peripheral surface of the first agitator gear 19 in a rotating direction of the first agitator gear 19.

Details of the shaft 11 and the electrode 23 will be described next with reference to FIGS. 3 to 5.

1-7. Shaft 11

The developing cartridge 1 further includes the shaft 11. The shaft 11 is positioned at the first outer surface 3A of the casing 3. That is, the shaft 11 is positioned at the one side of the casing 3 in the first direction. Specifically, the shaft 11 extends in the first direction from the first outer surface 3A. The shaft 11 has a cylindrical shape. The shaft 11 is positioned opposite to the coupling 6 with respect to the casing 3 in the first direction. The shaft 11 is positioned opposite to the second agitator gear 20 with respect to the casing 3 in the first direction. Put another way, the shaft 11 is positioned on the same side as the first agitator gear 19 with respect to the casing 3 in the first direction.

The shaft 11 is positioned between the developing-roller shaft 2A and the agitator shaft 4A in a second direction. The second direction is defined as a direction connecting the shaft 11 and the developing-roller shaft 2A. Further, the second direction is orthogonal to the first direction.

1-8. Electrode 23

The electrode 23 is an electrode for supplying electric power to the developing roller 2. Specifically, the electrode 23 is configured to receive electric power from the image-forming apparatus. The electrode 23 includes the first protrusion 25. The electrode 23 also has an insertion hole 23C. The insertion hole 23C penetrates the electrode 23 in the first direction. The shaft 11 at the first outer surface 3A of the casing 3 is inserted through the insertion hole 23C. With this structure, the electrode 23 is rotatable about the shaft 11.

As illustrated in FIGS. 2 and 3, the electrode 23 is positioned opposite to the coupling 6 with respect to the casing 3 in the first direction. The electrode 23 is positioned opposite to the second agitator gear 20 with respect to the casing 3 in the first direction. The electrode 23 is positioned between the developing-roller shaft 2A and the agitator shaft 4A in the second direction.

Referring to FIG. 3, the electrode 23 has one end portion 23A and another end portion 23B separated from the one end portion 23A in the first direction. The one end portion 23A is positioned farther away from the first outer surface 3A in the first direction than the other end portion 23B is from the first outer surface 3A. The electrode 23 is made of an electrically conductive resin. The electrically conductive resin is POM (polyacetal) resin, for example.

The electrode 23 can receive a drive force from the first agitator gear 19. Specifically, as illustrated in FIGS. 3 and 5, the electrode 23 includes a plurality of gear teeth 24. The plurality of gear teeth 24 is provided on a portion of a periphery of the electrode 23. The plurality of gear teeth 24 is provided in a rotating direction of the electrode 23. Specifically, as illustrated in FIGS. 3 and 5, the plurality of gear teeth 24 is provided on a portion of a periphery of the other end portion 23B of the electrode 23 in the rotating direction of the electrode 23. At least one gear tooth 24 of the plurality of gear teeth 24 is meshed with the first agitator gear 19. Specifically, at least one gear tooth 24 of the plurality of gear teeth 24 is meshed with at least one gear tooth of the plurality of gear teeth of the first agitator gear 19. This structure allows the electrode 23 to rotate about the shaft 11 in accordance with the rotation of the coupling gear 10.

As described above, the plurality of gear teeth 24 is provided on a portion of the periphery of the electrode 23. That is, the electrode 23 includes a toothless part where the plurality of teeth 24 is not provided. The toothless part is aligned with the plurality of gear teeth 24 in the rotating direction of the electrode 23 on the other end portion 23B. With this structure, as the electrode 23 rotates, the meshing between the electrode 23 and the first agitator gear 19 can be released.

Since the electrode 23 has the toothless part, the rotation of the electrode 23 can be stopped after the meshing between the plurality of gear teeth 24 of the electrode 23 and the first agitator gear 19 is released.

Figure 5:
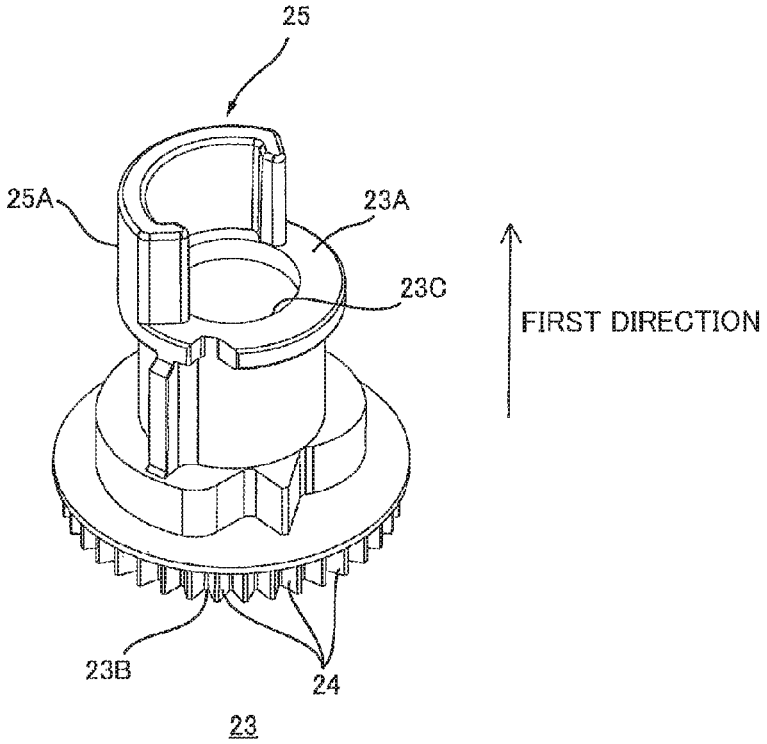
FIG. 5 is a perspective view of an electrode of the developing cartridge according to the first embodiment shown in FIG. 3.

As illustrated in FIGS. 3 and 5, the electrode 23 includes the first protrusion 25. The first protrusion 25 is positioned at the one end portion 23A. The first protrusion 25 is rotatable together with the electrode 23. More in detail, the first protrusion 25 extends in the first direction from the one end portion 23A. The first protrusion 25 is made of the above-mentioned electrically conductive resin. The first protrusion 25 is formed integrally with the electrode 23. Alternatively, the first protrusion 25 may be mounted to the one end portion 23A.

As illustrated in FIGS. 3 and 5, the first protrusion 25 is positioned around the insertion hole 23C. As illustrated in FIG. 1, the first protrusion 25 is positioned around a distal end portion 11A of the shaft 11. More specifically, as illustrated in FIG. 7, the first protrusion 25 extends along a portion of a peripheral surface 11C of the shaft 11. In other words, the first protrusion 25 extends in the rotating direction of the electrode 23. The first protrusion 25 has a first arc surface 25A. The first arc surface 25A is an outer peripheral surface of the first protrusion 25 extending in the rotating direction of the electrode 23. The first arc surface 25A extends along a portion of the peripheral surface 11C of the shaft 11. In other words, the first arc surface 25A extends in the rotating direction of the electrode 23.

The first arc surface 25A defines a central angle whose angle θ1 is equal to or larger than 10 degrees but equal to or smaller than 320 degrees. Specifically, the central angle of the first arc surface 25A is defined by a virtual line segment S1 and a virtual line segment S2. The virtual line segment S1 is a line segment connecting an axis A4 of the shaft 11 and one end portion of the first arc surface 25A in the rotating direction of the electrode 23. The line segment S2 is a line segment connecting the axis A4 and another end portion of the first arc surface 25A in the rotating direction of the electrode 23. The line segments S1 and S2 are orthogonal to the axis A4. As illustrated in FIG. 1, same as the first protrusion 25, the first arc surface 25A is exposed outside through the opening 31A of the cover 31.

1-9. Bearing Member 12

As illustrated in FIGS. 3 and 4, the developing cartridge 1 further includes a bearing member 12. The bearing member 12 is a member configured to receive the developing-roller shaft 2A. The bearing member 12 is made of the above-mentioned electrically conductive resin, for example. The bearing member 12 is electrically connected to the developing-roller shaft 2A. The bearing member 12 is positioned at the first outer surface 3A. More specifically, the bearing member 12 is positioned between the first outer surface 3A and the electrode 23 in the first direction. The bearing member 12 receives the developing-roller shaft 2A inserted therein.

Specifically, the bearing member 12 has a hole 12A. The hole 12A penetrates the bearing member 12 in the first direction. The one end portion 2B of the developing-roller shaft 2A is inserted into the hole 12A. The bearing member 12 contacts the one end portion 2B of the developing-roller shaft 2A. Specifically, an inner peripheral surface of the hole 12A contacts an outer peripheral surface of the one end portion 2B of the developing-roller shaft 2A. The bearing member 12 further has an opening 12B. The opening 12B is positioned spaced apart from the hole 12A in the second direction. The opening 12B penetrates the bearing member 12 in the first direction. The shaft 11 is inserted through the opening 12B.

1-10. Relay Electrode 13

As illustrated in FIGS. 3 and 4, the developing cartridge 1 further includes a relay electrode 13. The relay electrode 13 is a member for electrically connecting the bearing member 12 and electrode 23. Thus, the electrode 23 can receive electric power from the image-forming apparatus and supply the received electric power to the bearing member 12 through the relay electrode 13. As a result, the developing-roller shaft 2A can receive electric power through the bearing member 12.

More specifically, as illustrated in FIGS. 3 and 4, the relay electrode 13 is positioned at the first outer surface 3A. The relay electrode 13 is positioned between the first outer surface 3A and the electrode 23 in the first direction. The relay electrode 13 is positioned between the developing-roller shaft 2A and the agitator shaft 4A in the second direction. As illustrated in FIG. 4, the relay electrode 13 has an opening 14A. The opening 14A penetrates the relay electrode 13 in the first direction. The shaft 11 is inserted through the opening 14A.

Figure 6:
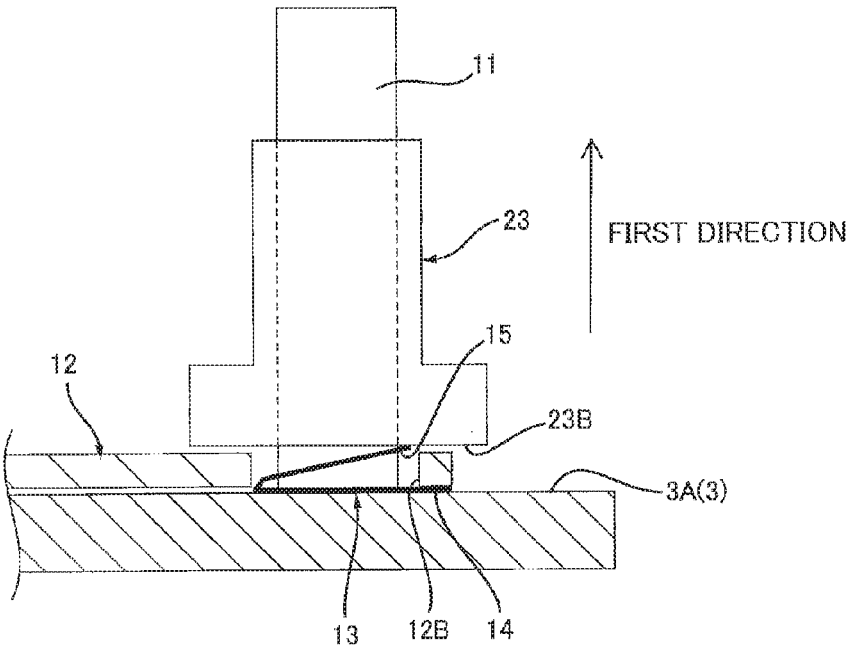
FIG. 6 is a schematic diagram showing the bearing member and the relay electrode attached to the casing of the developing cartridge according to the first embodiment shown in FIG. 3.

As illustrated in FIG. 6, the relay electrode 13 electrically connects the bearing member 12 and the electrode 23. The relay electrode 13 is made of a metal such as a stainless steel, for example. The relay electrode 13 is in contact with the bearing member 12. More specifically, the relay electrode 13 includes a first contact 14 and a second contact 15. The first and second contacts 14 and 15 are spaced apart from each other in the first direction. More specifically, as illustrated in FIG. 4, the second contact 15 is positioned to be spaced apart from an outer periphery of the shaft 11. As illustrated in FIG. 6, the first contact 14 is in contact with the bearing member 12. Specifically, the first contact 14 is sandwiched between the first outer surface 3A and the bearing member 12 in the first direction. The second contact 15 is in contact with the other end portion 23B of the electrode 23 through the opening 12B.

The relay electrode 13 is configured by folding a single metal plate. That is, the relay electrode 13 is a leaf spring. The relay electrode 13 can press the electrode 23 in a direction away from the casing 3. Due to the contact of the second contact 15 against the other end portion 23B of the electrode 23, the relay electrode 13 is deformed such that the second contact 15 approaches the first contact 14 in the first direction. The deformation of the relay electrode 13 accumulates elastic energy therein and the relay electrode 13 presses the electrode 23 by the elastic energy. More in detail, the second contact 15 presses the other end portion 23B of the electrode 23 by the elastic energy. Thus, stable contact between the relay electrode 13 and the electrode 23 is achieved.

With the above configuration, the developing-roller shaft 2A and the electrode 23 are electrically connected to each other. Specifically, the electrode 23 is electrically connected to the developing-roller shaft 2A through the relay electrode 13 and the bearing member 12. Further, as described above, the electrode 23 is made of an electrically conductive resin, and the relay electrode 13 is made of a metal, for example. The other end portion 23B of the electrode 23 is in contact with the second contact 15 of the relay electrode 13. Thus, the electrode 23 is electrically connected to the relay electrode 13.

2. Detection of the Developing Cartridge 1

Figure 8:
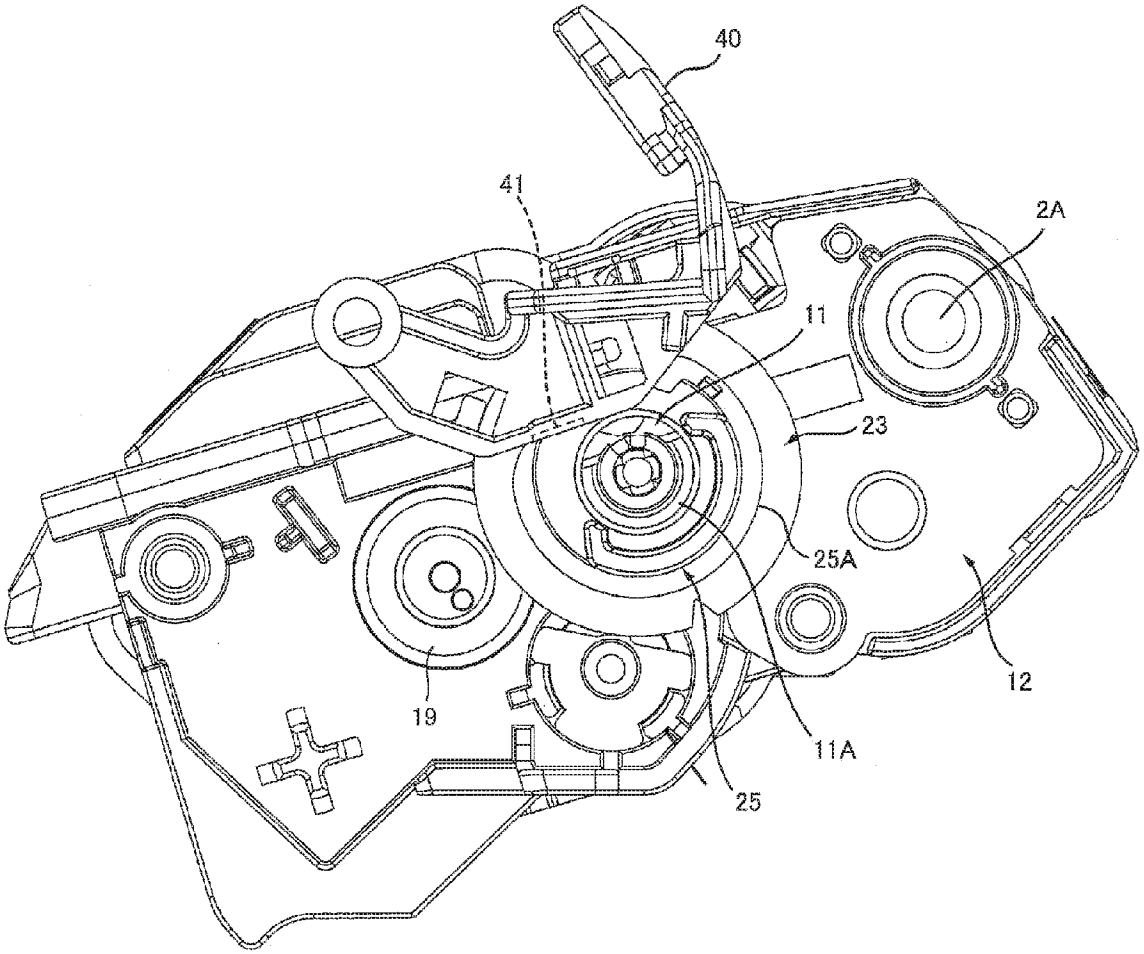
FIG. 8 is a view explaining how the developing cartridge according to the first embodiment is detected after the state of FIG. 7, wherein the electrode has rotated and the first protrusion is separated from the device-side electrode.

Detection of the developing cartridge 1 will be described next with reference to FIGS. 7 to 9.

The developing cartridge 1 can be detachably attached to the image-forming apparatus. The attached developing cartridge 1 can be detected by the image-forming apparatus. As illustrated in FIG. 7, the image-forming apparatus includes a lever 40, a main-body electrode 41, and a detector (not shown). The image-forming apparatus further includes the drive-force input part (not shown). The lever 40 can move upon contact against the first protrusion 25 of the electrode 23. More in detail, the lever 40 is configured to pivot about an axis (not shown) extending in the first direction. The main-body electrode 41 is provided on the lever 40.

When the developing cartridge 1 is attached to the image-forming apparatus, the main-body electrode 41 contacts the first arc surface 25A of the first protrusion 25, as illustrated in FIG. 7. The lever 40 is thus positioned at a first position. The detector then detects that the lever 40 is at the first position. When the main-body electrode 41 in contact with the first arc surface 25A starts electric power supply, the electrode 23 can supply electric power to the developing-roller shaft 2A through the relay electrode 13 and the bearing member 12.

When the drive-force input part starts inputting the drive force to the coupling 6 in a state where the developing cartridge 1 is attached to the image-forming apparatus, the electrode 23 rotates about the shaft 11 as described above. Accordingly, the first protrusion 25 rotates together with the electrode 23. Then, as illustrated in FIG. 8, the first arc surface 25A of the first protrusion 25 is separated from the main-body electrode 41. That is, the first arc surface 25A is not in contact with the main-body electrode 41. Accordingly, the electrical connection between the main-body electrode 41 and the electrode 23 is released, thereby stopping power supply to the developing-roller shaft 2A. Further, at this time, as illustrated in FIG. 8, the lever 40 is moved from the first position to a second position. At the second position, the lever 40 contacts the distal end portion 11A of the shaft 11. The detector thus detects that the lever 40 is at the second position.

Figure 9:
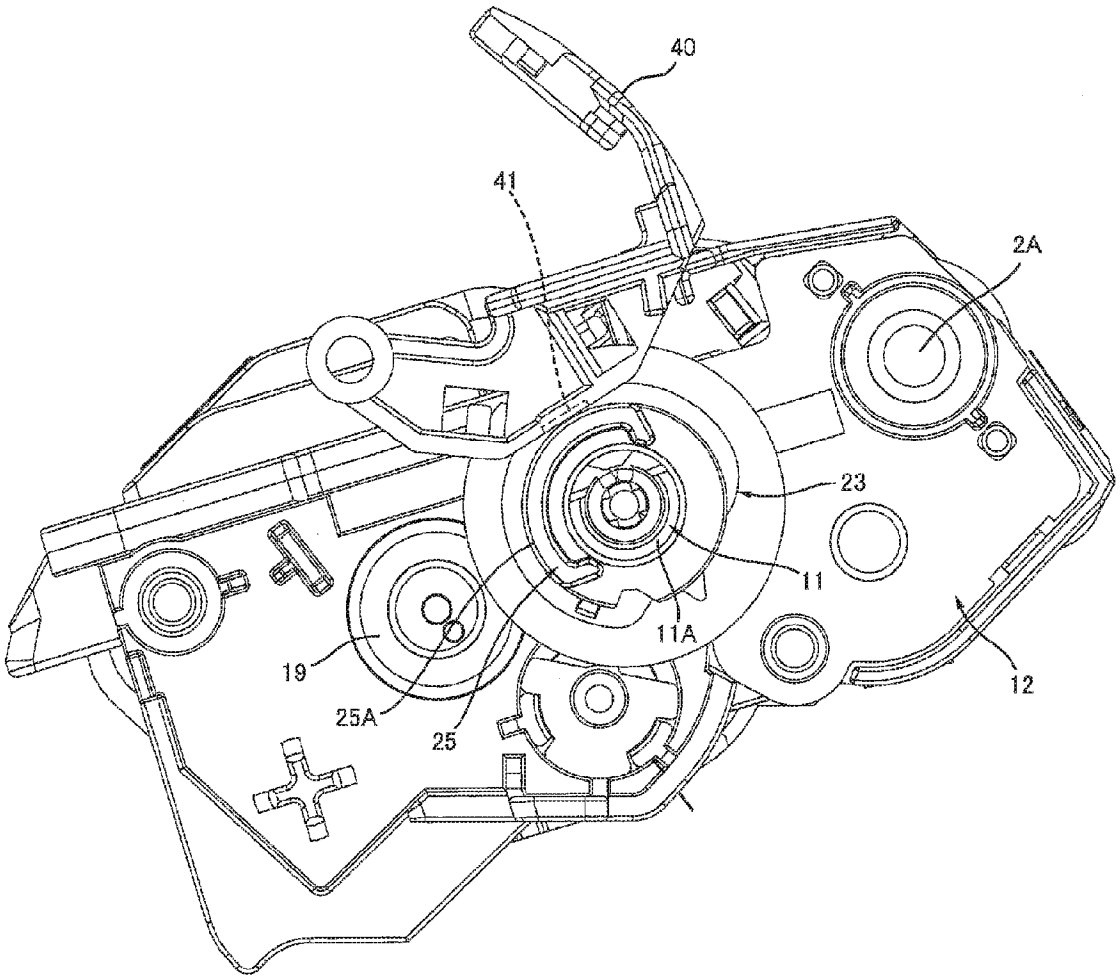
FIG. 9 is a view explaining how the developing cartridge according to the first embodiment is detected after the state of FIG. 8, wherein the electrode has rotated and the first protrusion is in contact with the device-side electrode again.

Thereafter, as illustrated in FIG. 9, the first protrusion 25 further rotates together with the electrode 23, bringing the first arc surface 25A into contact with the main-body electrode 41 again. At this time, as illustrated in FIG. 9, the lever 40 moves from the second position back to the first position.

Then, the meshing between the plurality of gear teeth 24 of the electrode 23 and the first agitator gear 19 is released. That is, the toothless part of the electrode 23 faces the first agitator gear 19. The rotation of the electrode 23 is thereby stopped. That is, the electrode 23 stops rotating with the first arc surface 25A in contact with the main-body electrode 41.

As a result, the electrode 23 can supply power once again to the developing-roller shaft 2A through the relay electrode 13 and the bearing member 12. The lever 40 maintains the first position. The detector detects that the lever 40 is at the first position. When the detector detects that the lever 40 has moved from the first position to the second position and then back to the first position from the second position within a predetermined period of time, the image-forming apparatus can determine a specification of the developing cartridge 1 based on the positional changes of the lever 40. The specification of the developing cartridge 1 may be, for example, whether or not the developing cartridge 1 is new. Alternatively, the specification of the developing cartridge 1 may be, for example, on how many sheets printing can be performed using the developing cartridge 1. The image-forming apparatus can identify a specific number of sheets that can be printed with the developing cartridge 1 from the positional transition of the lever 40 attributed to rotation of the electrode 23.

When the detector detects that the lever 40 stays at the first position for a predetermined period of time, the image-forming apparatus may determine that a used developing cartridge 1 is attached. Incidentally, if the developing cartridge 1 is not attached to the image-forming apparatus, the lever 40 is positioned at the second position. As a result, the image-forming apparatus can determine specification of the developing cartridge 1 (whether or not the developing cartridge 1 is new; and whether or not the developing cartridge 1 is attached to the image-forming apparatus) by using the electrode 23.

3. Operational and Technical Advantages of the First Embodiment

As illustrated in FIG. 7, the developing cartridge 1 includes the electrode 23 rotatable about the shaft 11 and that is configured to supply electric power to the developing roller 2. The electrode 23 can supply electric power to the developing roller 2 when in contact with the main-body electrode 41. Further, the electrode 23 includes the first protrusion 25 rotatable with the electrode 23. The rotation of the first protrusion 25 together with the electrode 23 causes the lever 40 to move. The image-forming apparatus can determine the specification of the developing cartridge 1 based on the positional change of the lever 40. That is, the single electrode 23 can serve to move the lever 40 as well as to supply electric power to the developing roller 2. As a result, the specification of the developing cartridge 1 can be detected by using the electrode 23.

Further, as illustrated in FIG. 3, the developing cartridge 1 further includes the bearing member 12 and the relay electrode 13. The bearing member 12 receives the developing-roller shaft 2A inserted thereinto and is electrically connected to the developing-roller shaft 2A. The relay electrode 13 electrically connects the bearing member 12 and the electrode 23. Thus, the electrode 23 can reliably supply electric power to the developing roller 2 through the relay electrode 13 and the bearing member 12.

4. Second Embodiment

Next, a developing cartridge 45 according to a second embodiment will be described with reference to FIGS. 10 through 15. In the following description, like parts and components of the developing cartridge 45 are designated with the same reference numerals as those of the developing cartridge 1 of the first embodiment to avoid duplicating explanations.

4-1. Overview of the Developing Cartridge 45

The developing cartridge 1 of the first embodiment and developing cartridge 45 of the second embodiment differ from each other in the number of sheets on which printing can be performed. That is, an amount of the developer contained in the casing 3 of the developing cartridge 45 differs from that of the developer contained in the casing 3 of the developing cartridge 1.

Figure 10:
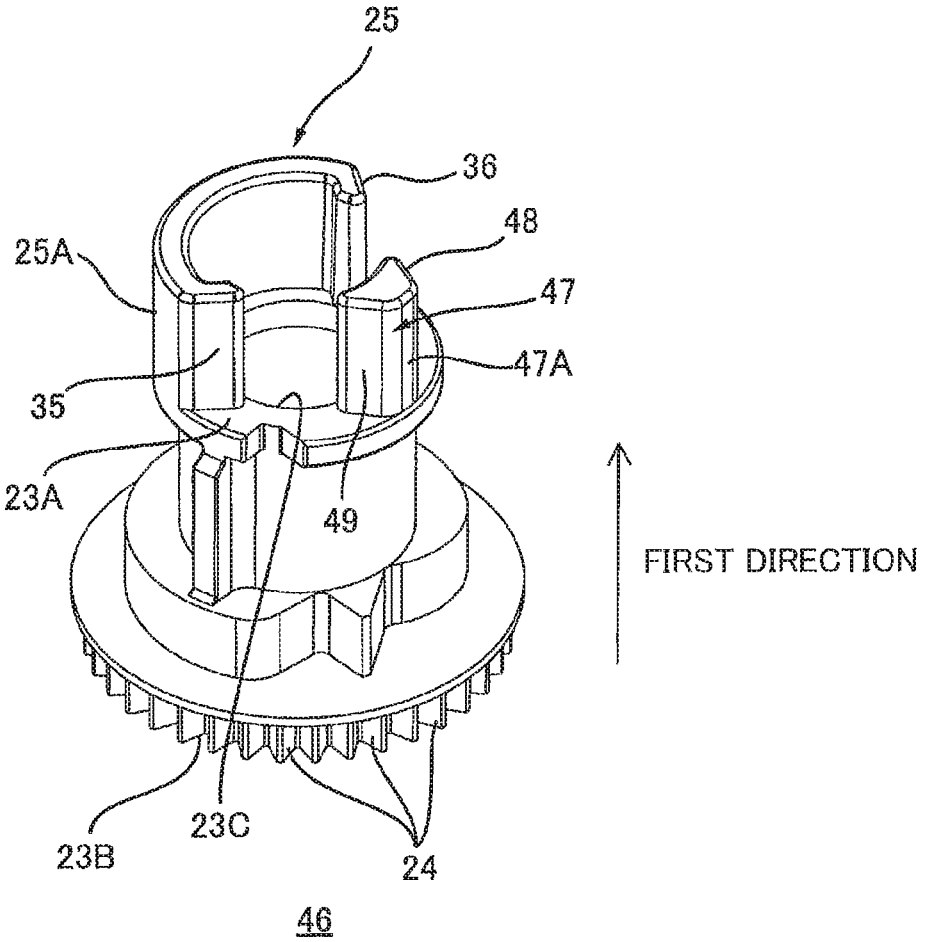
FIG. 10 is a perspective view of an electrode provided in a developing cartridge according to a second embodiment of the disclosure.
Figure 11:
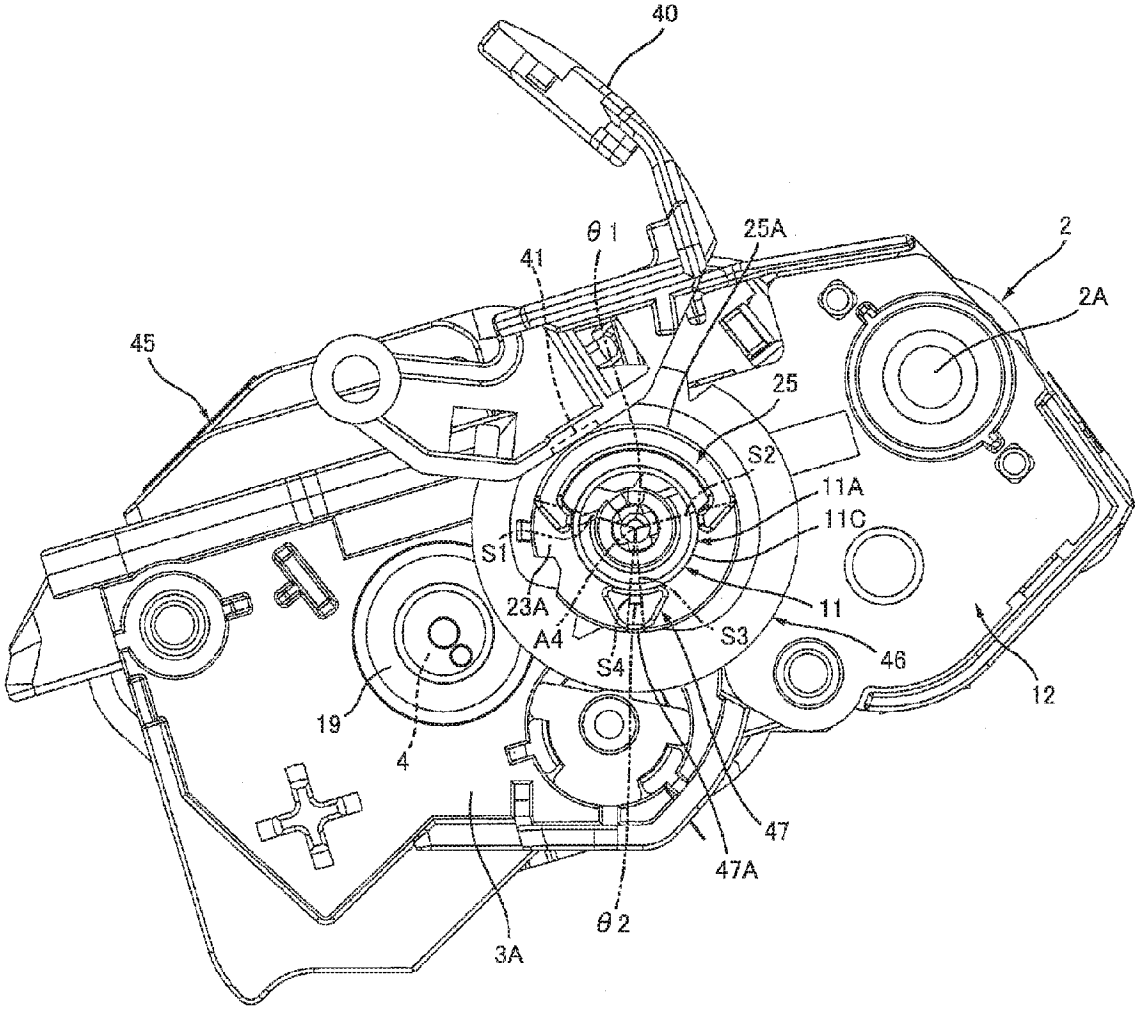
FIG. 11 is a view explaining how the developing cartridge according to the second embodiment is detected, wherein the electrode has rotated and the first protrusion is separated from the device-side electrode.

Specifically, as illustrated in FIGS. 10 and 11, the developing cartridge 45 of the second embodiment includes an electrode 46, instead of the electrode 23. The electrode 46 includes a second protrusion 47 in addition to the first protrusion 25. The electrode 46 has the same structure as that of the electrode 23 of the first embodiment except that the second protrusion 47 is provided.

4-2. Second Protrusion 47

The second protrusion 47 is positioned at the one end portion 23A. The second protrusion 47 is rotatable together with the electrode 46. Specifically, the second protrusion 47 extends in the first direction from the one end portion 23A. The second protrusion 47 is made of the above-mentioned electrically conductive resin. The second protrusion 47 is formed integrally with the electrode 46. Alternatively, the second protrusion 47 may be mounted to the one end portion 23A.

As illustrated in FIG. 10, the second protrusion 47 is positioned around the insertion hole 23C. As illustrated in FIG. 11, the second protrusion 47 is positioned around the distal end portion 11A of the shaft 11. More specifically, the second protrusion 47 extends along a part of the peripheral surface 11C of the shaft 11. In other words, the second protrusion 47 extends in a rotating direction of the electrode 46. The second protrusion 47 has a second arc surface 47A. The second arc surface 47A is an outer peripheral surface of the second protrusion 47 extending in the rotating direction of the electrode 46. The second arc surface 47A extends along a portion of the peripheral surface 11C of the shaft 11. That is, the second arc surface 47A extends in the rotating direction of the electrode 46.

The second arc surface 47A defines a central angle whose angle θ2 is equal to or larger than 10 degrees but equal to or smaller than 250 degrees. Specifically, the central angle of the second arc surface 47A is defined by a virtual line segment S3 and a virtual line segment S4. The virtual line segment S3 is a line segment connecting the axis A4 of the shaft 11 and one end portion of the second arc surface 47A in the rotating direction of the electrode 46. The line segment S4 is a line segment connecting the axis A4 and another end portion of the second arc surface 47A in the rotating direction of the electrode 46. The line segments S3 and S4 are orthogonal to the axis A4.

The first arc surface 25A has a radius of curvature that is equal to a radius of curvature of the second arc surface 47A. The radius of curvature of the first arc surface 25A is defined by a length of a line segment that is orthogonal to the axis A4 of the shaft 11 and that connects the axis A4 and the first arc surface 25A. That is, the radius of curvature of the first arc surface 25A is equal to a length of the line segment S1. The curvature radius of the second arc surface 47A is defined by a length of a line segment that is orthogonal to the axis A4 and that connects the axis A4 and the second arc surface 47A. That is, the radius of curvature of the second arc surface 47A is equal to a length of the line segment S3. The line segments S1, S2, S3, and S4 have the same length as each other. The angle θ1 of the central angle of the first arc surface 25A is larger than the angle θ2 of the central angle of the second arc surface 47A. That is, in the rotating direction of the electrode 46, a length of the first arc surface 25A is larger than a length of the second arc surface 47A.

Figure 12:
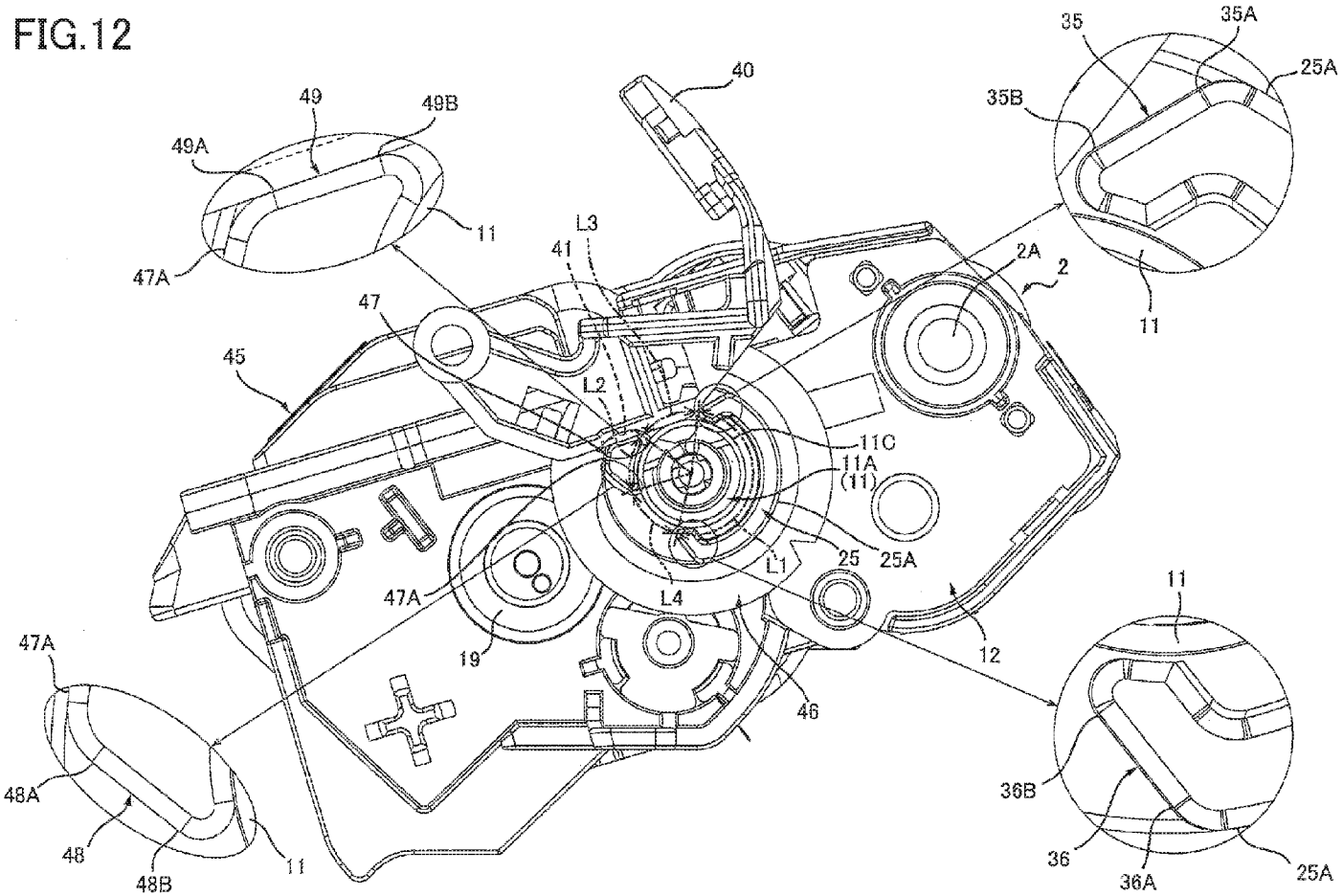
FIG. 12 is a view explaining how the developing cartridge according to the second embodiment is detected after the state of FIG. 11, wherein the electrode has rotated and the first protrusion is separated from the device-side electrode.

Specifically, as illustrated in FIG. 12, the first protrusion 25 has a first length L1 in the rotating direction of the electrode 46 that is different from a second length L2 of the second protrusion 47 in the rotating direction of the electrode 46. Specifically, in the present embodiment, the first length L1 of the first protrusion 25 is larger than the second length L2 of the second protrusion 47. The first length L1 is a length between the one end portion and the other end portion of the first protrusion 25 in the rotating direction of the electrode 46.

More specifically, as illustrated in FIG. 10, the first protrusion 25 has a first slope 35 and a second slope 36. The first slope 35 is positioned at the one end portion of the first protrusion 25 in the rotating direction of the electrode 46. The second slope 36 is positioned at the other end portion of the first protrusion 25 in the rotating direction of the electrode 46. As illustrated in FIG. 12, in a state where the electrode 46 is mounted to the shaft 11, the first slope 35 extends toward the shaft 11 continuously from the one end portion of the first arc surface 25A in the rotating direction of the electrode 46. Specifically, the first slope 35 has one end portion 35A and another other end portion 35B spaced apart from the one end portion 35A in the rotating direction of the electrode 46. In the rotating direction of the electrode 46, the other end portion 35B is positioned farther away from the first arc surface 25A than the one end portion 35A is from the first arc surface 25A. In the state where the electrode 46 is mounted to the shaft 11, the second slope 36 extends toward the shaft 11 continuously from the other end portion of the first arc surface 25A in the rotating direction of the electrode 46. Specifically, the second slope 36 has one end portion 36A and another end portion 36B spaced apart from the one end portion 36A in the rotating direction of the electrode 46. In the rotating direction of the electrode 46, the other end portion 36B is positioned farther away from the first arc surface 25A than the one end portion 36A is from the first arc surface 25A. The first length L1 is a length between the other end portion 35B of the first slope 35 and the other end portion 36B of the second slope 36 in the rotating direction of the electrode 46.

The second length L2 is a length between one end portion and another end portion of the second protrusion 47 in the rotating direction of the electrode 46. More in detail, as illustrated in FIG. 10, the second protrusion 47 has a first slope 48 and a second slope 49. The first slope 48 is positioned at the one end portion of the second protrusion 47 in the rotating direction of the electrode 46. The second slope 49 is positioned at the other end portion of the second protrusion 47 in the rotating direction of the electrode 46. More specifically, as illustrated in FIG. 12, in the state where the electrode 46 is mounted to the shaft 11, the first slope 48 extends toward the shaft 11 continuously from one end portion of the second arc surface 47A in the rotating direction of the electrode 46. The first slope 48 has one end portion 48A and another end portion 48B spaced apart from the one end portion 48A in the rotating direction of the electrode 46. In the rotating direction of the electrode 46, the other end portion 48B is positioned farther away from the second arc surface 47A than the one end portion 48A is from the second arc surface 47A. In the state where the electrode 46 is mounted to the shaft 11, the second slope 49 extends toward the shaft 11 continuously from the other end portion of the second arc surface 47A in the rotating direction of the electrode 46. The second slope 49 has one end portion 49A and another end portion 49B spaced apart from the one end portion 49A in the rotating direction of the electrode 46. In the rotating direction of the electrode 46, the other end portion 49B is positioned farther away from the second arc surface 47A than the one end portion 49A is from the second arc surface 47A. The second length L2 is a length between the other end portion 48B of the first slope 48 and the other end portion 49B of the second slope 49 in the rotating direction of the electrode 46.

The second protrusion 47 is positioned spaced apart from the first protrusion 25 in the rotating direction of the electrode 46. More specifically, the second slope 49 is positioned at an interval L3 from the first slope 35 in the rotating direction of the electrode 46. The interval L3 is a length between the other end portion 35B of the first slope 35 and the other end portion 49B of the second slope 49 in the rotating direction of the electrode 46. The first slope 48 is positioned at an interval L4 from the second slope 36 in the rotating direction of the electrode 46. The interval L4 is a length between the other end portion 48B of the first slope 48 and the other end portion 36B of the second slope 36 in the rotating direction of the electrode 46.

4-3. Detection of the Developing Cartridge 45

Next, detection of the developing cartridge 45 will be described with reference to FIGS. 11 through 15.

When the developing cartridge 45 is attached to the image-forming apparatus, the main-body electrode 41 contacts the first arc surface 25A of the first protrusion 25, as illustrated in FIG. 11. The lever 40 is thus positioned at the first position. The detector thus detects that the lever 40 is at the first position. When the main-body electrode 41 starts electric power supply while in contact with the first arc surface 25A, the electrode 46 can supply electric power to the developing-roller shaft 2A through the relay electrode 13 and the bearing member 12.

When the drive-force input part starts inputting the drive force to the coupling 6 in the state where the developing cartridge 45 is attached to the image-forming apparatus, the electrode 46 rotates about the shaft 11 as described above. Accordingly, the first protrusion 25 and second protrusion 47 rotate together with the electrode 46.

As the electrode 46 rotates, as illustrated in FIG. 12, the first arc surface 25A of the first protrusion 25 is separated from the main-body electrode 41. Then, as illustrated in FIG. 12, the lever 40 is moved from the first position to the second position. At the second position, the lever 40 contacts the distal end portion 11A of the shaft 11 between the first protrusion 25 and the second protrusion 47 in the rotating direction of the electrode 46. The detector detects that the lever 40 is at the second position.

Figure 13:
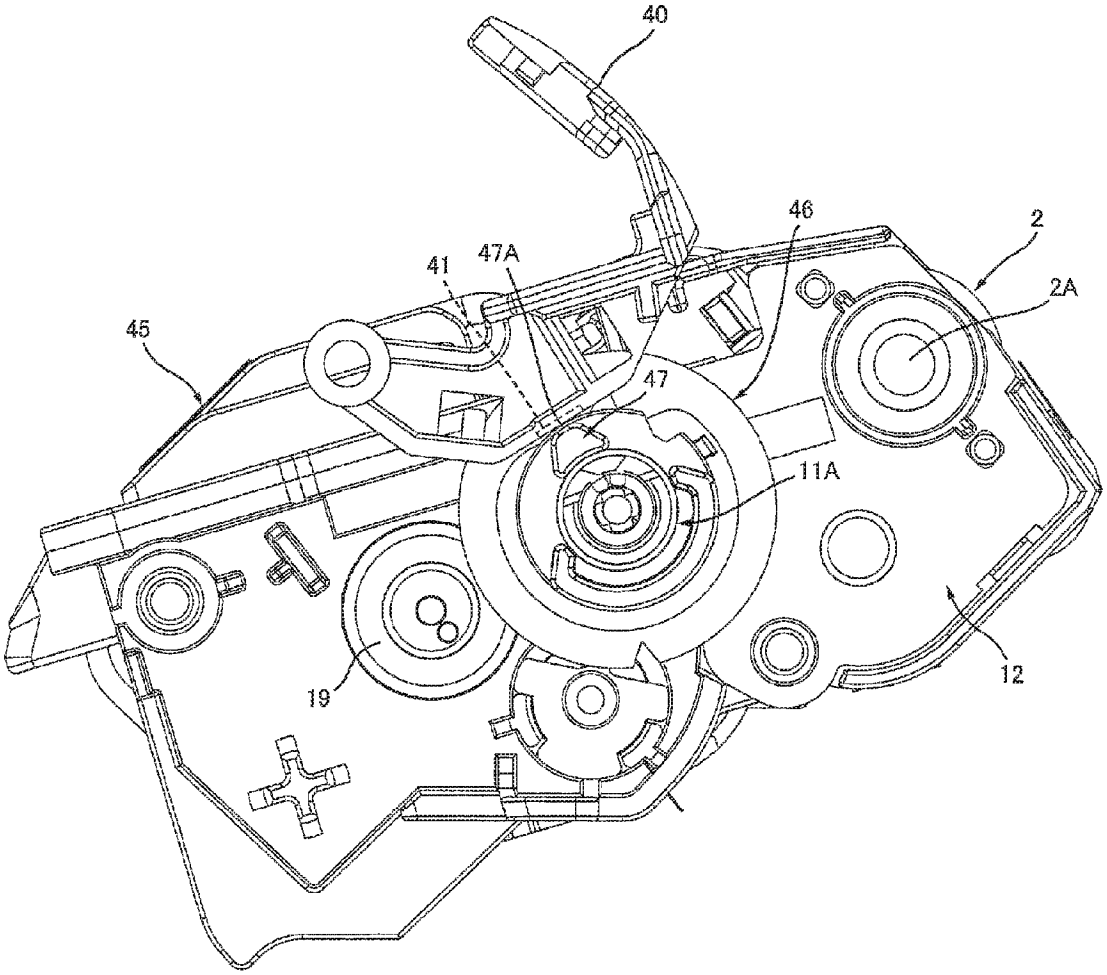
FIG. 13 is a view explaining how the developing cartridge according to the second embodiment is detected after the state of FIG. 12, wherein the electrode has rotated and a second protrusion is in contact with the device-side electrode.

Thereafter, as illustrated in FIG. 13, the second protrusion 47 further rotates together with the electrode 46 to bring the second arc surface 47A into contact with the main-body electrode 41. At this time, the lever 40 is moved from the second position to the first position.

Figure 14:
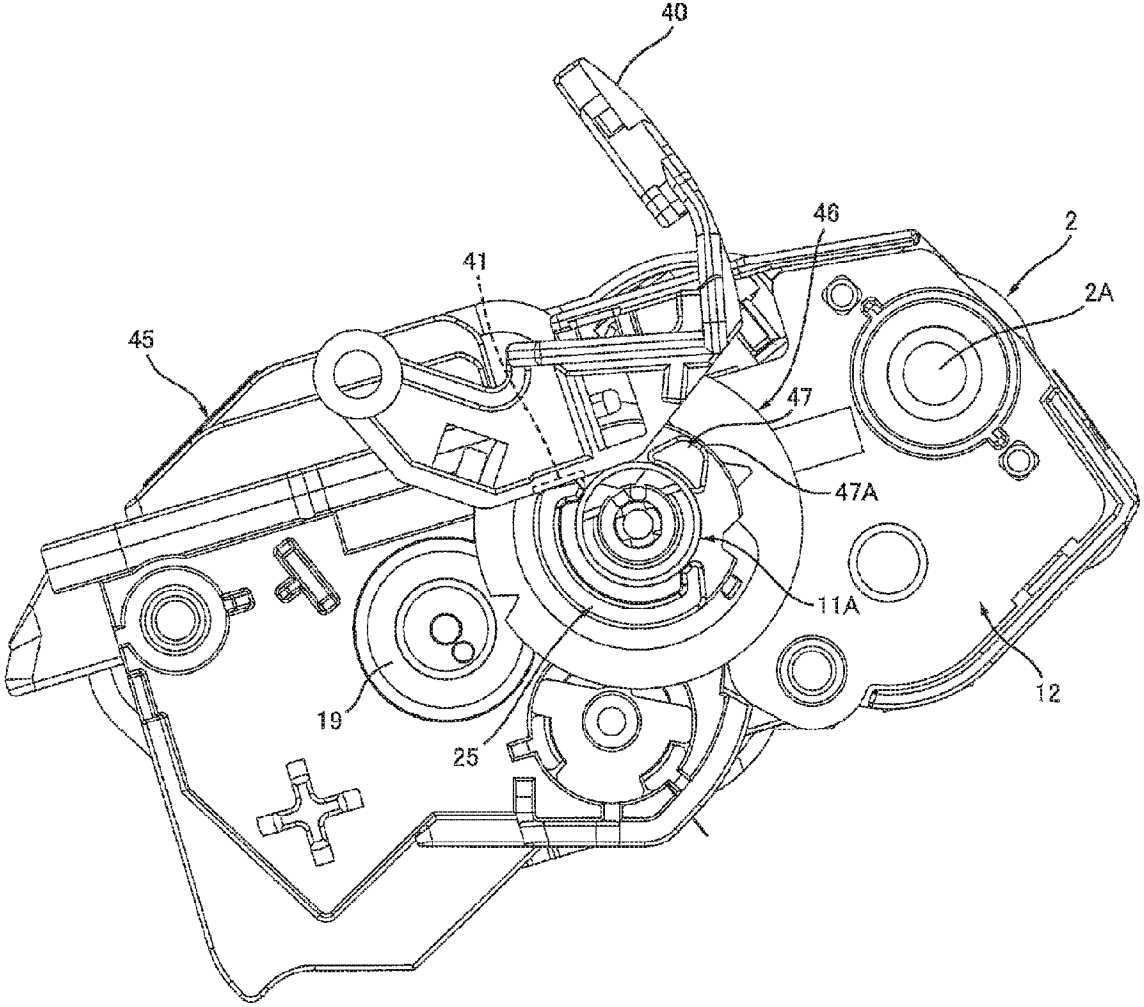
FIG. 14 is a view explaining how the developing cartridge according to the second embodiment is detected after the state of FIG. 13, wherein the electrode has rotated and the second protrusion is separated from the device-side electrode.

Thereafter, as illustrated in FIG. 14, the second arc surface 47A of the second protrusion 47 is separated from the main-body electrode 41 as the electrode 46 further rotates. The lever 40 again moves from the first position to the second position. At the second position, the lever 40 contacts the distal end portion 11A of the shaft 11. The detector thus detects that the lever 40 is at the second position.

Figure 15:
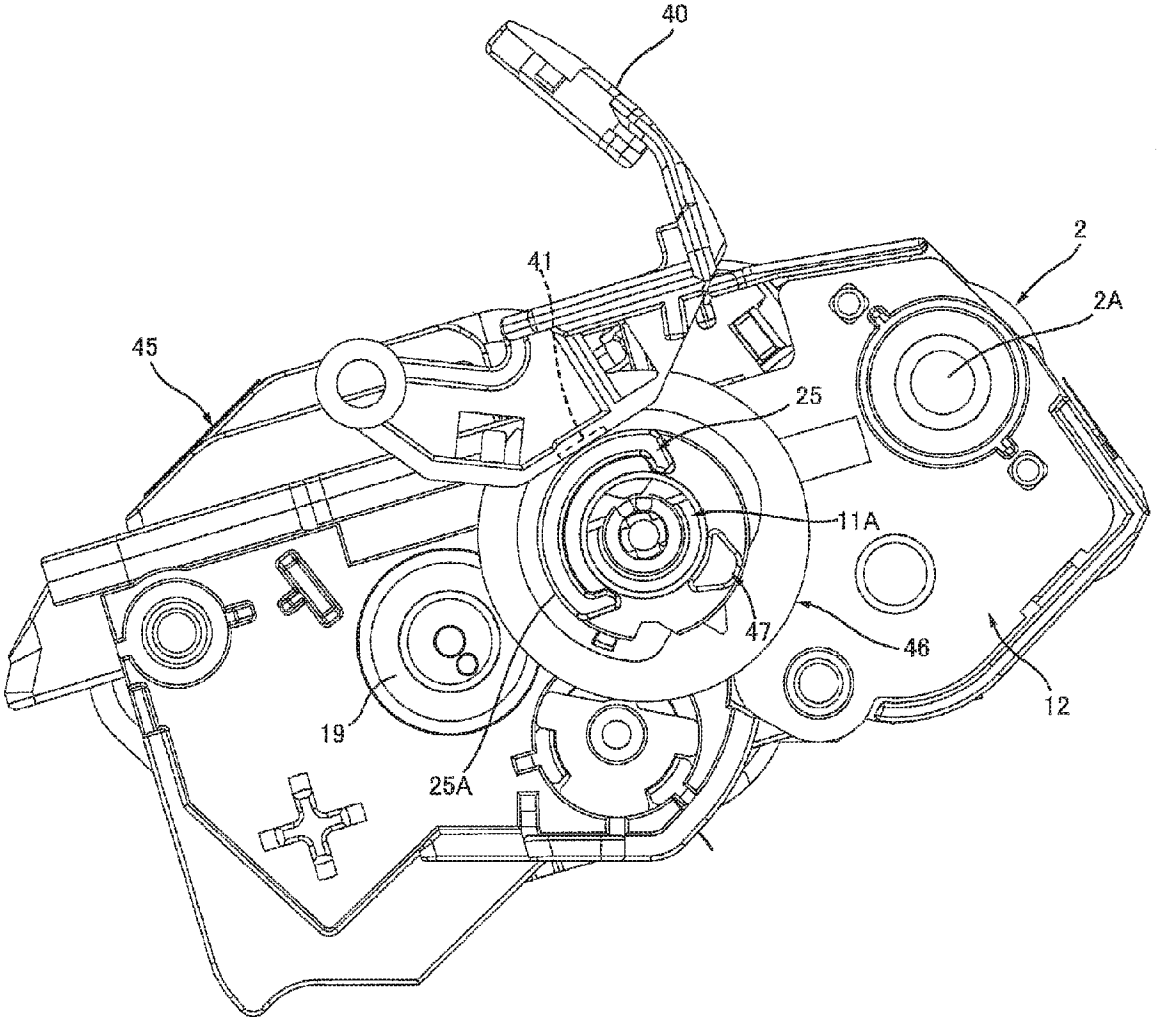
FIG. 15 is a view explaining how the developing cartridge according to the second embodiment is detected after the state of FIG. 14, wherein the electrode has rotated and the first protrusion is in contact with the device-side electrode.

Thereafter, as illustrated in FIG. 15, the first protrusion 25 further rotates together with the electrode 46 to cause the first arc surface 25A to make contact with the main-body electrode 41. The lever 40 moves from the second position back to the first position. At this time, the meshing between the plurality of gear teeth 24 and the first agitator gear 19 is released. That is, the toothless part of the electrode 46 faces the first agitator gear 19. Accordingly, the electrode 46 stops rotating with the first arc surface 25A in contact with the main-body electrode 41.

As a result, the electrode 46 can supply electric power once again to the developing-roller shaft 2A through the relay electrode 13 and the bearing member 12. The lever 40 maintains the first position. The detector detects that the lever 40 is at the first position. When the detector detects that the lever 40 moves, within a predetermined period of time, from the first position to the second position, then from the second position to the first position and, then from the first position to the second position, and then from the second position to the first position, the image-forming apparatus can determine the specification of the developing cartridge 45 based on the positional changes of the lever 40. The specification of the developing cartridge 45 may be, for example, whether or not the developing cartridge 45 is new. Alternatively, the specification of the developing cartridge 45 may be, for example, the number of sheets on which printing can be performed with the developing cartridge 45.

The positional transition of the lever 40 made by the electrode 46 differs from the positional transition of the lever 40 made by the electrode 23. Hence, the image-forming apparatus can determine that the number of sheets that can be used for printing with the developing cartridge 1 differs from the number of sheets that can be used for printing with the developing cartridge 45. The image-forming apparatus can therefore identify the specific number of sheets that can be used for printing with the developing cartridge 45 from the positional transition of the lever 40 attributed to the electrode 46.

4-4. Operational and Technical Advantages of the Second Embodiment

As illustrated in FIG. 11, the electrode 46 includes the first protrusion 25 and second protrusion 47. Thus, as in the first embodiment, the single electrode 46 can function to move the lever 40 as well as to supply electric power to the developing roller 2.

Further, the electrode 46 includes two protrusions (first protrusion 25 and second protrusion 47). Thus, the number of times of movement of the lever 40 can be increased as compared to the electrode 23 having only one protrusion (first protrusion 25). This structure can make the positional transition of the lever 40 made by the electrode 46 different from the positional transition of the lever 40 made by the electrode 23 having only one protrusion. Further, the detector can be made to detect the difference in the positional transition of the lever 40. Accordingly, the image-forming apparatus can determine that the specification of the developing cartridge 45 provided with the electrode 46 including two protrusions differs from the specification of the developing cartridge 1 provided with the electrode 23 including only one protrusion.

5. Third Embodiment

Figure 16:
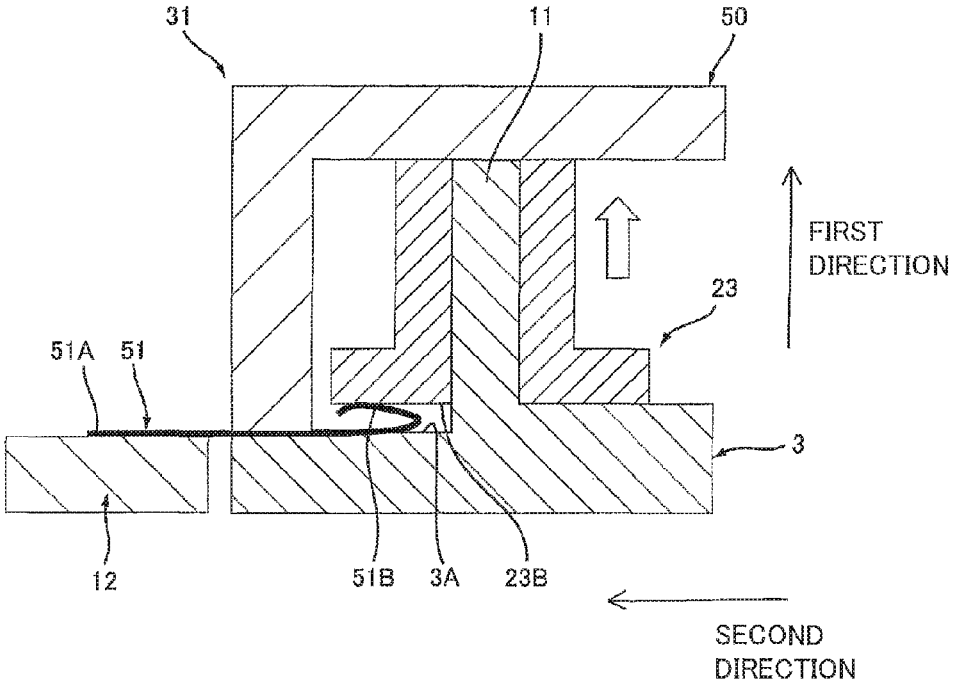
FIG. 16 is a schematic diagram of a developing cartridge according to a third embodiment of the disclosure.

A developing cartridge 50 according to a third embodiment will be described with reference to FIG. 16. In the following description, like parts and components of the developing cartridge 50 are designated with the same reference numerals as those of the developing cartridge 1 of the first embodiment to avoid duplicating explanations.

In the developing cartridge 50 of the third embodiment, the electrode 23 is positioned to be spaced away from the bearing member 12 in the second direction. The developing cartridge 50 includes a relay electrode 51, in place of the relay electrode 13, for electrically connecting the electrode 23 and the bearing member 12.

Specifically, the electrode 23 is positioned at the first outer surface 3A. The relay electrode 51 is in contact with the bearing member 12. The relay electrode 51 is also in contact with the electrode 23. The relay electrode 51 extends in the second direction.

More specifically, the relay electrode 51 has a first contact 51A and a second contact 51B. The first contact 51A is positioned at one end portion of the relay electrode 51 in the second direction. The second contact 51B is positioned at another end portion of the relay electrode 51 in the second direction. The first contact 51A is in contact with the bearing member 12. The second contact 51B is sandwiched between the first outer surface 3A and the electrode 23 in the first direction. The second contact 51B is in contact with the other end portion 23B of the electrode 23.

The second contact 51B is configured by folding a portion of a single metal plate. The relay electrode 51 can press the electrode 23 in a direction away from the casing 3. When the second contact 51B contacts the other end portion 23B of the electrode 23, the relay electrode 51 is deformed such that the second contact 51B comes closer to the first outer surface 3A in the first direction. The deformation of the relay electrode 51 accumulates elastic energy therein and the relay electrode 51 presses the electrode 23 with the elastic energy. More in detail, the second contact 51B presses the other end portion 23B of the electrode 23 by the elastic energy. Thus, stable contact between the relay electrode 51 and the electrode 23 is achieved.

In the third embodiment, the relay electrode 51 electrically connects the electrode 23 and the bearing member 12.

Thus, the electrode 23 is electrically connected to the developing-roller shaft 2A through the relay electrode 51 and the bearing member 12.

The structure of the third embodiment can realize the same operational and technical advantages of the first embodiment.

6. Fourth Embodiment

Figure 17:
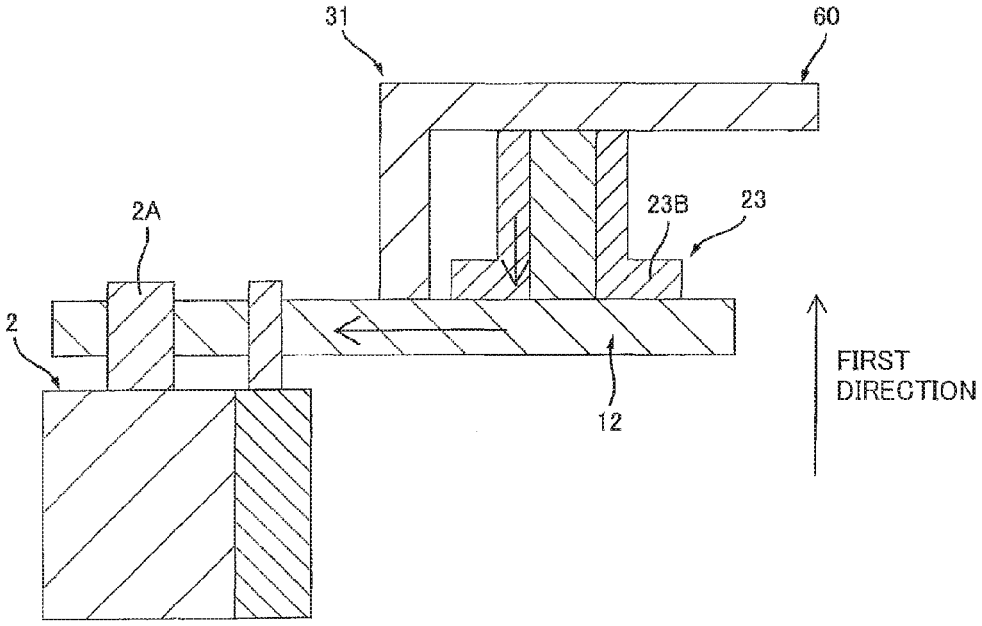
FIG. 17 is a schematic diagram of a developing cartridge according to a fourth embodiment of the disclosure.

A developing cartridge 60 according to a fourth embodiment will be now described with reference to FIG. 17. In the following description, like parts and components of the developing cartridge 60 are designated with the same reference numerals as those of the developing cartridge 50 of the third embodiment to avoid duplicating explanations.

The developing cartridge 60 of the fourth embodiment has no relay electrode. Instead, the electrode 23 is electrically connected to the bearing member 12. The electrode 23 is in contact with the bearing member 12. Specifically, the other end portion 23B of the electrode 23 is in direct contact with the bearing member 12. This structure allows the electrode 23 to be electrically connected to the developing-roller shaft 2A through the bearing member 12. The structure of the fourth embodiment can realize the same operational and technical advantages of the first embodiment.

7. Fifth Embodiment

Figure 18:
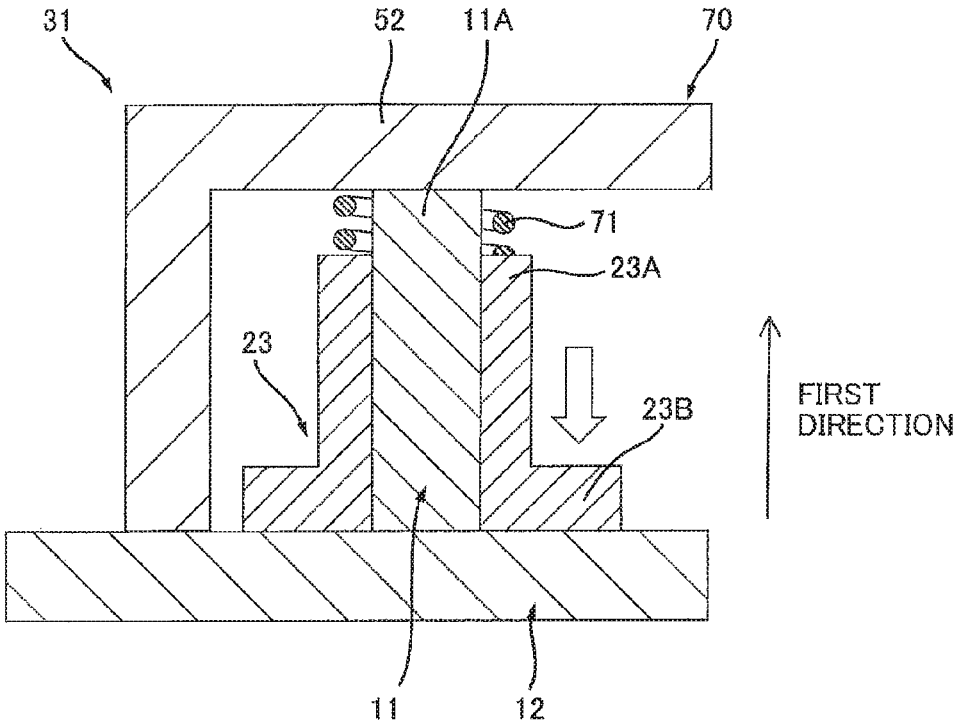
FIG. 18 is a schematic diagram of a developing cartridge according to a fifth embodiment of the disclosure.

A developing cartridge 70 according to a fifth embodiment will be described next with reference to FIG. 18. In the following description, like parts and components of the developing cartridge 70 are designated with the same reference numerals as those of the developing cartridge 60 of the fourth embodiment to avoid duplicating explanations.

The developing cartridge 70 further includes a pressing member 71. The pressing member 71 presses the electrode 23 toward the bearing member 12. The pressing member 71 is, for example, a spring, specifically, a coil spring. The pressing member 71 is positioned around the distal end portion 11A of the shaft 11. The pressing member 71 is positioned between the cover 31 and the electrode 23 in the first direction. The pressing member 71 has one end portion in the first direction that is in contact with the cover 31. The pressing member 71 has another end in the first direction that is in contact with the electrode 23.

More in detail, the cover 31 includes a wall 52. The wall 52 is positioned opposite to the bearing member 12 with respect to the electrode 23 in the first direction. The pressing member 71 is positioned between the wall 52 and the one end portion 23A of the electrode 23 in the first direction. The one end portion of the pressing member 71 in the first direction contacts the wall 52. The other end of the pressing member 71 in the first direction contacts the one end portion 23A of the electrode 23. As a result, the wall 52 receives a reaction force from the pressing member 71. The pressing member 71 thus presses the electrode 23 against the bearing member 12 in the first direction.

According to the fifth embodiment, the pressing member 71 presses the electrode 23 against the bearing member 12. This structure allows the electrode 23 and the bearing member 12 to reliably contact each other. As a result, the electrode 23 can be reliably electrically connected to the developing-roller shaft 2A through the bearing member 12.

Incidentally, the pressing member 71 may be formed of rubber.

The structure of the fifth embodiment can realize the same operational and technical advantages of the first embodiment.

8. Sixth Embodiment

Figure 19:
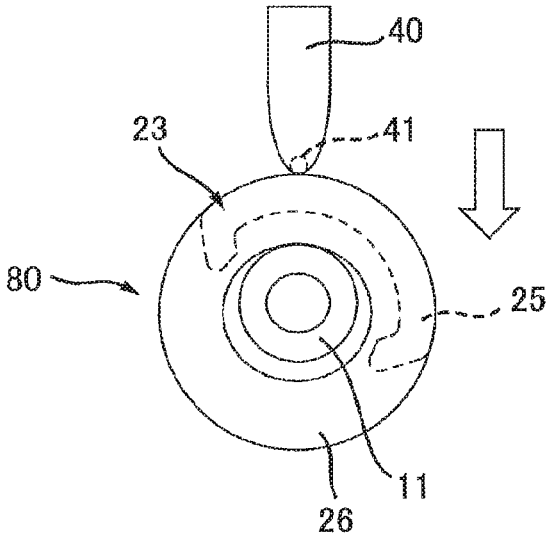
FIG. 19 is a schematic diagram of a developing cartridge according to a sixth embodiment of the disclosure.

A developing cartridge 80 according to a sixth embodiment will be described next with reference to FIG. 19. In the following description, like parts and components of the developing cartridge 80 are designated with the same reference numerals as those of the developing cartridge 1 of the first embodiment to avoid duplicating explanations.

In the developing cartridge 80, the bearing member 12 is electrically connected to the shaft 11. The shaft 11 extends in the first direction from the bearing member 12. That is, the shaft 11 is formed integrally with the bearing member 12. The shaft 11 is made of the above-mentioned electrically conductive resin.

The electrode 23 can contact the shaft 11 when the electrode 23 is contacted by the main-body electrode 41. That is, the electrode 23 and the shaft 11 are in contact with each other. This structure allows the electrode 23 to be electrically connected to the developing-roller shaft 2A through the shaft 11 and the bearing member 12.

The structure of the sixth embodiment can realize the same operational and technical advantages of the first embodiment.

Incidentally, the shaft 11 may be provided separately from the bearing member 12. In this case, the shaft 11 and the bearing member 12 may be designed to contact each other.

9. Other Variations and Modifications (1) The above-described first protrusion 25 is integrally formed with the electrode 23. However, the first protrusion 25 may be formed integrally with or separately from the electrode 23, as long as the first protrusion 25 can rotate together with the electrode 23. A protrusion separate from the electrode 23 may be provided on the electrode 23 to be mounted thereto. Further, one or more of protrusions may be provided on the electrode 23, in addition to the first protrusion 25. Still alternatively, two protrusions, provided separately from the electrode 23, may be mounted to the electrode 23.

(2) In the second embodiment, the length of the first arc surface 25A in the rotating direction of the electrode 46 is larger than the length of the second arc surface 47A in the rotating direction of the electrode 46. However, the length of the first arc surface 25A in the rotating direction of the electrode 46 and the length of the second arc surface 47A in the rotating direction of the electrode 46 may be equal to each other. Alternatively, the length of the second arc surface 47A in the rotating direction of the electrode 46 may be larger than the length of the first arc surface 25A in the rotating direction of the electrode 46.

(3) In the first embodiment, the drive force is transmitted to the electrode 23 from the coupling 6 when the plurality of gear teeth 24 and the first agitator gear 19 are meshed with each other. Thereafter, when the meshing between the plurality of gear teeth 24 and the first agitator gear 19 is released, the transmission of the drive force from the coupling 6 to the electrode 23 is terminated.

A configuration to cancel the transmission of the drive force to the electrode 23 is not especially limited. For example, the developing cartridge 1 may include an intermediate gear between the first agitator gear 19 and the electrode 23. In this case, a plurality of gear teeth may be formed on a portion of a periphery of the intermediate gear. That is, the intermediate gear may have the plurality of gear teeth and a toothless part. Thus, as the intermediate gear rotates, the meshing of the intermediate gear with the gear (first agitator gear 19 or the gear teeth 24 of the electrode 23) can be released.

Further, the intermediate gear may be configured to move in the first direction during its rotation. In this case, the plurality of gear teeth may be formed over the entire periphery of the intermediate gear, or may be partially formed on the periphery. The intermediate gear can move in the first direction during rotation thereof, thereby releasing the meshing thereof with the gear (first agitator gear 19 or the gear teeth 24 of the electrode 23).

Even with these configurations, transmission of the drive force to the electrode 23 can be stopped. Note that in these cases, the plurality of gear teeth may be provided on the entire periphery of the electrode 23 or a portion of the periphery of the electrode 23.

(4) The above-described electrode 23 includes the plurality of gear teeth 24. However, the electrode 23 may have a friction member such as a rubber in place of the plurality of gear teeth 24. Further, the electrode 46 may have a friction member such as a rubber, in place of the plurality of gear teeth. Further, the above-described intermediate gear of the variation (3) may have a friction member such as a rubber, in place of the plurality of gear teeth.

While the disclosure is described in detail with reference to the specific embodiments thereof while referring to accompanying drawings, it would be apparent to those skilled in the art that many modifications and variations may be made therein without departing from the scope of the disclosure.

What is claimed is:

1. A developing cartridge comprising:

a casing configured to store developer;

a developing roller rotatable about a first axis extending in a first direction, the casing having one end and another end in the first direction;

a shaft positioned at the one end of the casing, the shaft extending in the first direction and having a peripheral surface; and an electrode rotatable about the shaft in a rotating direction and configured to supply electric power to the developing roller, the electrode comprising a first protrusion rotatable together with the electrode, the first protrusion extending along a portion of the peripheral surface of the shaft, a second protrusion extending along the peripheral surface of the shaft, the second protrusion being positioned spaced apart from the first protrusion in the rotating direction, wherein the first protrusion has a first length in the rotating direction, and the second protrusion has a second length different from the first length in the rotating direction.

2. The developing cartridge according to claim 1, wherein the first protrusion has a first arc surface extending in the rotating direction, the first arc surface defining a center angle that is equal to or larger than 10 degrees but equal to or smaller than 320 degrees.

3. The developing cartridge according to claim 1, wherein the second protrusion has a second arc surface extending in the rotating direction, the second arc surface defining a center angle that is equal to or larger than 10 degrees but equal to or smaller than 250 degrees.

4. The developing cartridge according to claim 1, wherein the first protrusion and the second protrusion extend in the first direction.

5. The developing cartridge according to claim 1, wherein the first protrusion extends in the first direction.

6. The developing cartridge according to claim 1, wherein the electrode comprises a plurality of gear teeth, the plurality of gear teeth being arranged on a portion of a periphery of the electrode in the rotating direction.

7. The developing cartridge according to claim 3, further comprising:

an agitator configured to agitate the developer, the agitator being rotatable about a second axis extending in the first direction, the agitator having one end and another end in the first direction; and a first agitator gear positioned at the one end of the agitator and rotatable together with the agitator, the first agitator gear being meshed with at least one gear tooth of the plurality of gear teeth of the electrode.

8. The developing cartridge according to claim 7, further comprising:

a second agitator gear positioned at the other end of the agitator and configured to rotate together with the agitator;

an idle gear meshed with the second agitator gear; and a coupling rotatable about a third axis extending in the first direction, the coupling comprising a coupling gear meshed with the idle gear.

9. The developing cartridge according to claim 8, further comprising a developing-roller gear rotatable together with the developing roller, the developing roller having one end and another end in the first direction, the developing-roller gear being positioned at the other end of the developing roller, the developing-roller gear being meshed with the coupling gear.

10. The developing cartridge according to claim 8, wherein the coupling is configured to receive a drive force, the coupling being rotatable about the third axis upon receipt of the drive force.

11. A developing cartridge comprising:

a casing configured to store developer;

a developing roller rotatable about a first axis extending in a first direction, the casing having one end and another end in the first direction, and the developing roller comprising a developing-roller shaft extending in the first direction;

a shaft positioned at the one end of the casing, the shaft extending in the first direction and having a peripheral surface;

an electrode rotatable about the shaft in a rotating direction and configured to supply electric power to the developing roller, the electrode including a first protrusion rotatable together with the electrode, the first protrusion extending along a portion of the peripheral surface of the shaft, and the developing-roller shaft being electrically connected to the electrode;

a bearing member receiving the developing-roller shaft and electrically connected to the developing-roller shaft, the bearing member being in contact with the electrode; and a pressing member configured to press the electrode toward the bearing member, wherein the pressing member is a spring.

12. The developing cartridge according to claim 11, further comprising:

a relay electrode electrically connecting the bearing member and the electrode.

13. The developing cartridge according to claim 11, wherein the shaft and the electrode are in contact with each other.

14. The developing cartridge according to claim 11, wherein the electrode comprises a plurality of gear teeth, the plurality of gear teeth being arranged on a portion of a periphery of the electrode in the rotating direction.

15. The developing cartridge according to claim 14, further comprising:

an agitator configured to agitate the developer, the agitator being rotatable about a second axis extending in the first direction, the agitator having one end and another end in the first direction; and a first agitator gear positioned at the one end of the agitator and rotatable together with the agitator, the first agitator gear being meshed with at least one gear tooth of the plurality of gear teeth of the electrode.

16. A developing cartridge comprising:

a casing configured to store developer;

a developing roller rotatable about a first axis extending in a first direction, the casing having one end and another end in the first direction, and the developing roller comprising a developing-roller shaft extending in the first direction;

a shaft positioned at the one end of the casing, the shaft extending in the first direction and having a peripheral surface;

an electrode rotatable about the shaft in a rotating direction and configured to supply electric power to the developing roller, the electrode including a first protrusion rotatable together with the electrode, the first protrusion extending along a portion of the peripheral surface of the shaft, and the developing-roller shaft being electrically connected to the electrode;

a bearing member receiving the developing-roller shaft and electrically connected to the developing-roller shaft, the bearing member being in contact with the electrode;

a pressing member configured to press the electrode toward the bearing member; and a cover covering a portion of the electrode, wherein the pressing member is disposed between the cover and the electrode in the first direction, the pressing member having one end and another end opposite each other in the first direction, the one end of the pressing member being in contact with the cover, the other end of the pressing member being in contact with the electrode.

17. The developing cartridge according to claim 16, further comprising:

a relay electrode electrically connecting the bearing member and the electrode.

18. The developing cartridge according to claim 16, wherein the shaft and the electrode are in contact with each other.

19. The developing cartridge according to claim 16, wherein the electrode comprises a plurality of gear teeth, the plurality of gear teeth being arranged on a portion of a periphery of the electrode in the rotating direction.

20. The developing cartridge according to claim 19, further comprising:

an agitator configured to agitate the developer, the agitator being rotatable about a second axis extending in the first direction, the agitator having one end and another end in the first direction; and a first agitator gear positioned at the one end of the agitator and rotatable together with the agitator, the first agitator gear being meshed with at least one gear tooth of the plurality of gear teeth of the electrode.

* * * * *